US008965243B2

(12) United States Patent
Hayashida

(10) Patent No.: US 8,965,243 B2
(45) Date of Patent: Feb. 24, 2015

(54) DEVELOPING APPARATUS, PROCESS CARTRIDGE AND METHOD FOR ASSEMBLING DEVELOPING APPARATUS

(71) Applicant: Canon Kabushiki Kaisha, Tokyo (JP)

(72) Inventor: Makoto Hayashida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 13/676,311

(22) Filed: Nov. 14, 2012

(65) Prior Publication Data

US 2013/0142541 A1 Jun. 6, 2013

(30) Foreign Application Priority Data

Nov. 15, 2011 (JP) ..... 2011-249893
Apr. 26, 2012 (JP) ..... 2012-101130
Oct. 23, 2012 (JP) ..... 2012-234028

(51) Int. Cl.
*G03G 15/08* (2006.01)
*G03G 21/18* (2006.01)

(52) U.S. Cl.
CPC ..... *G03G 15/0898* (2013.01); *G03G 15/0882* (2013.01); *G03G 21/1832* (2013.01)
USPC ..... 399/106; 399/102; 399/103; 29/428; 264/261

(58) Field of Classification Search
USPC ..... 399/102, 103
See application file for complete search history.

(56) References Cited

U.S. PATENT DOCUMENTS 6,188,855 B1 * 2/2001 Fujioka ..... 399/106
7,933,534 B2 4/2011 Hoshi et al.
2002/0064392 A1 * 5/2002 Miura et al. ..... 399/103
2009/0154951 A1 * 6/2009 Askren et al. ..... 399/103
2011/0170903 A1 7/2011 Hoshi et al.
2013/0129377 A1 5/2013 Satomura et al.

FOREIGN PATENT DOCUMENTS

JP 9-6106 1/1997
JP 9006106 A * 10/1997 ..... G03G 15/08

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A developing device for an image forming apparatus, comprising a frame provided with a developer accommodating chamber accommodating a developer, and a development opening for supplying the developer from an inside of the developer accommodating chamber to an outside; a first sealing member sealing the development opening, the first sealing member being dismountable from the development opening by being pulled out through a pulling opening provided in the frame; and a second sealing member for sliding on the first sealing member to prevent the developer from leaking to an outside of the frame through the pulling opening when the first sealing member is pulled through the pulling opening, wherein the second sealing member is integrally molded on the frame by injecting a thermoplastic elastomer into a space between the first sealing member and an edge of the pulling opening.

15 Claims, 21 Drawing Sheets

(a)

(b)

(a)

(b)

(a)

(b)

DEVELOPING APPARATUS, PROCESS CARTRIDGE AND METHOD FOR ASSEMBLING DEVELOPING APPARATUS

FIELD OF THE INVENTION AND RELATED ART

The present invention relates to a developing apparatus, a process cartridge and a method for assembling a developing apparatus.

In the field of an electrophotographic image forming apparatus, it has been common practice to employ a process cartridge system, which integrates an electrophotographic photosensitive member (which hereafter may be referred to simply as photosensitive drum), a developing apparatus (device), etc., in the form of a cartridge, which is removably installable in the main assembly of an electrophotographic image forming apparatus. A process cartridge system makes it possible for a user of an electrophotographic image forming apparatus to maintain the apparatus without relying on a service person. Thus, it can substantially improve an electrophotographic image forming apparatus in usability.

The developing apparatus (device) in a process cartridge has a frame having a development chamber and a developer storage chamber. The development chamber is the chamber in which a developer bearing member for supplying the peripheral surface of the photosensitive drum in the process cartridge with developer is placed. The development chamber and developer storage chamber are in connection to each other through an opening which is between the two chambers.

Thus, it has to be ensured that the developer in the developer storage chamber of a process cartridge does not leak into the development chamber of the process cartridge during the period between the production of the process cartridge and when the process cartridge is used for the first time. Thus, the aforementioned opening between the development chamber and developer storage chamber is kept sealed with a piece of film welded to the developer storage chamber frame. This sealing film is to be removed by a user, or automatically removed by the image forming apparatus, before the cartridge begins to be used for the first time, after the installation of the process cartridge into the apparatus main assembly.

At this time, referring to FIG. 21, a process cartridge B is described about its general structure. FIG. 21 is an exploded perspective view of the cartridge B, which is for describing the general structure of the cartridge B. As is evident from FIG. 21, the cartridge B is made up of a cleaning unit C and a development unit D. The cleaning unit C has a photosensitive drum 2 and a cleaning unit frame 9. The development unit D has a developer bearing member (unshown) and a development unit frame 13.

The development unit frame 13 is provided with an opening 13*a*, which is covered with a sealing film 103 for preventing the developer in the developer storage chamber of the development unit D from leaking. The sealing film 103 is welded to the rim of the opening 13*d*.

Further, the development unit frame 13 is provided with a slit 101 so that a user can extract the sealing film 103 from the process cartridge B through the slit 101, by pulling the end portion of the sealing film 103 outward of the development unit frame 13, that is, the direction indicated by an arrow mark X. That is, the sealing film 103 is removed from the development unit frame 13 by being extracted through the slit 101.

The developer in the development storage chamber has to be prevented from leaking from the process cartridge not only prior to the removal of the sealing 103, but also, after the removal of the sealing film 103. Thus, there have been proposed various methods for preventing the developer in the development storage chamber from leaking from the cartridge B. One of the methods is disclosed in Japanese Laid-open Application No. 3142746. Accordingly to this patent application, a sealing member 902 (FIG. 22) made of thermoplastic elastomer, sponge, or the like is inserted into the sealing film extraction slit 101 to keep the slit 101 plugged. One of the examples of feasible structural arrangements for the sealing member 902 is shown in FIG. 22. FIGS. 22(*a*)-22(*c*) are sectional views of the combination of the sealing member 902 and development unit frame 13, at a vertical plane which coincides with a line P1-P1, in FIG. 21, which is parallel to the direction indicated by the arrow mark X. FIGS. 22(*a*)-22(*c*) correspond to the state of sealing member 902 before, during, and after its insertion into the sealing film extraction slit 101, respectively.

Referring to FIG. 22(*a*), the sealing member 902 is made up of a base portion 902*a*, and fin portions 902*b* which perpendicularly project from the base portion 902*a*. Next, referring to FIG. 22(*b*), the sealing member 902 is to be inserted into the sealing film extraction slit 101 from the opposite direction from the direction indicated by the arrow mark X, while the sealing film 103 is kept tensioned by a preset amount of force applied to the sealing film 103 in the direction indicated by the arrow mark X. Further, the development unit frame 13 is structured so that as the sealing member 902 is inserted into the sealing film extraction slit 101, the angle of contact between each of the fin portions 902*a* and the sealing film 103 becomes a preset angle θ. Therefore, as the sealing film 103 is pulled out through the film extraction slit 101, the fin portions 902*b*, which are in contact with the sealing film 103 wipe away the developer having adhered to the sealing film 103, as shown in FIG. 22(*c*). Therefore, the developer does not leak through the sealing film extraction slit 101.

SUMMARY OF THE INVENTION

The present invention is one of the results of the further development of the structural arrangement for the sealing member for a process cartridge, such as the above described one. Thus, the primary object of the present invention is to provide a process cartridge and/or a developing apparatus, which is simpler in terms of the operation for attaching the sealing film, and the process for attaching the sealing member, than any of the process cartridges and developing apparatuses which are in accordance with the prior art.

According to an aspect of the present invention, there is provided a developing device for an image forming apparatus, comprising a frame provided with a developer accommodating chamber accommodating a developer, and a development opening for supplying the developer from an inside of said developer accommodating chamber to an outside; a first sealing member sealing said development opening, said first sealing member being dismountable from said development opening by being pulled out through a pulling opening provided in said frame; and a second sealing member for sliding on said first sealing member to prevent the developer from leaking to an outside of said frame through said pulling opening when said first sealing member is pulled through said pulling opening, wherein said second sealing member is integrally molded on said frame by injecting a thermoplastic elastomer into a space between said first sealing member and an edge of said pulling opening.

According to another aspect of the present invention, there is provided a developing device for an image forming apparatus, comprising a frame provided with a developer accommodating chamber accommodating a developer, and a development opening for supplying the developer from an inside of said developer accommodating chamber to an outside; a first sealing member sealing said development opening, said first sealing member being dismountable from said development opening by being pulled out through a pulling opening provided in said frame; and a second sealing member for sliding on said first sealing member to prevent the developer from leaking to an outside of said frame through said pulling opening when said first sealing member is pulled through said pulling opening, wherein said second sealing member is provided with a retaining portion for preventing said second sealing member from moving in a pulling direction of said first sealing member, by engaging with a regulating portion of said frame.

According to a further aspect of the present invention, there is provided a process cartridge detachably mountable to a main assembly of an image forming apparatus, said process cartridge comprising an image bearing member for bearing a latent image; a developer carrying member for carrying a developer; a frame provided with a developer accommodating chamber accommodating the developer, a developing chamber holding said developer carrying member, and a development opening for fluid communication between said developing chamber and said developer accommodating chamber; a first sealing member sealing said development opening, said first sealing member being dismountable from said development opening by being pulled out through a pulling opening provided in said frame; and a second sealing member for sliding on said first sealing member to prevent the developer from leaking to an outside of said frame through said pulling opening when said first sealing member is pulled through said pulling opening, wherein said second sealing member is integrally molded on said frame by injecting a thermoplastic elastomer into a space between said first sealing member and an edge of said pulling opening According to a further aspect of the present invention, there is provided a process cartridge detachably mountable to a main assembly of an image forming apparatus, said process cartridge comprising an image bearing member for bearing a latent image; a developer carrying member for carrying a developer; a frame provided with a developer accommodating chamber accommodating the developer, a developing chamber holding said developer carrying member, and a development opening for fluid communication between said developing chamber and said developer accommodating chamber; a first sealing member sealing said development opening, said first sealing member being dismountable from said development opening by being pulled out through a pulling opening provided in said frame; and a second sealing member for sliding on said first sealing member to prevent the developer from leaking to an outside of said frame through said pulling opening when said first sealing member is pulled through said pulling opening, wherein said second sealing member is provided with a retaining portion for preventing said second sealing member from moving in a pulling direction of said first sealing member, by engaging with a regulating portion of said frame.

According to a further aspect of the present invention, there is provided an assembling method for a developing device, said assembling method comprising preparing a frame provided with a developer accommodating chamber accommodating a developer, a development opening for supplying the developer from an inside of said developer accommodating chamber to an outside, and a pulling opening through which a first sealing member for sealing said development opening is pulled; and providing a second sealing member by injecting a thermoplastic elastomer into a space between said first sealing member and said pulling opening in a state that said first sealing member is mounted to said development opening to seal said development opening, thus sealing said pulling opening.

According to a further aspect of the present invention, there is provided an assembling method for a developing device, said assembling method comprising preparing a frame provided with a developer accommodating chamber accommodating a developer, a development opening for supplying the developer from an inside of said developer accommodating chamber to an outside, a pulling opening through which a first sealing member for sealing said development opening is pulled, and a regulating portion for suppressing movement of said second sealing member in a pulling direction of said first sealing member; and sealing said pulling opening by inserting said second sealing member into said pulling opening in a state that first sealing member is mounted to said development opening to seal said development opening, and engaging a retaining portion provided on said second sealing member with said regulating portion in a process of inserting said second sealing member into said pulling opening.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 5(*b*) is a schematic sectional view of the process cartridge, at a vertical plane parallel to the recording medium conveyance direction. FIG. 5(*c*) is a side view of the cartridge, as seen from the side from which the sealing film is extracted.

FIG. 14(*b*) is a perspective view of the sealing member in the third embodiment, and FIG. 14(*c*) is a schematic sectional view of the development unit frame 13 of the process cartridge, at a vertical plane which is parallel to the recording medium conveyance direction and intersects with the sealing film extraction slit. It shows the structure of the development unit frame 13, which corresponds in position to the sealing film extraction slit.

FIG. 15(*b*) is a schematic perspective view of the end portion of the development unit frame of the cartridge prior to the installation of the sealing member.

FIG. 20(*b*) is a schematic perspective view of the modified version of the sealing member, and shows the structure of the sealing member.

DESCRIPTION OF THE PREFERRED EMBODIMENTS (Overall Structure of Image Forming Apparatus)

Figure 1:
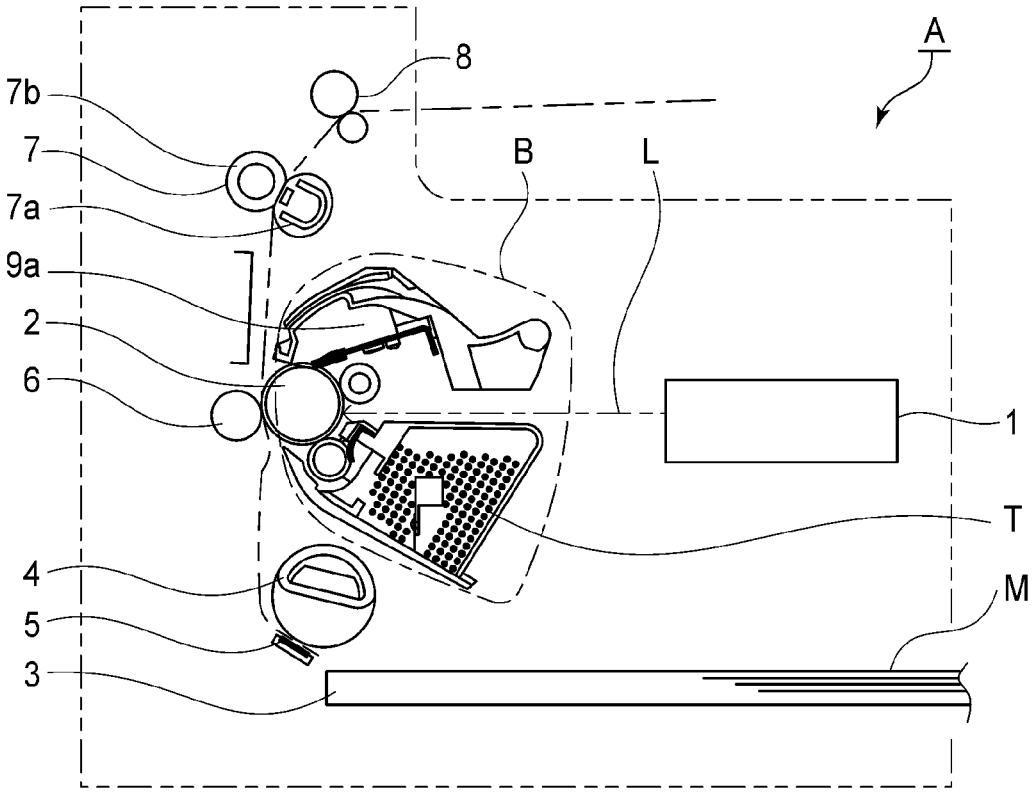
FIG. 1 is a schematic sectional view of the image forming apparatus in the first embodiment of the present invention, at a vertical plane parallel to the recording medium conveyance direction of the apparatus, and shows the general structure of the apparatus.

First, referring to FIG. 1, a typical electrophotographic image forming apparatus, with which the present invention is compatible, and which is in the form of a laser printer (which hereafter will be referred to simply as image forming apparatus A) is described about its overall structure. FIG. 1 is a schematic sectional view of the image forming apparatus A, at a vertical plane parallel to the recording medium conveyance direction of the apparatus A, and shows the general structure of the apparatus A. The image forming apparatus A has a laser scanner 1, a sheet feeder cassette 3, a pickup roller 4, a recording medium pressing member 5, a transfer roller 6, a fixing device 7, a pair of discharge rollers 8, and a recording medium conveying means, which are the major structural components of the apparatus A. Here, the recording medium conveying means is the means which conveys recording medium such as a sheet of paper, from the sheet feeder cassette 3 into the main assembly of the image forming apparatus A, and conveys the recording medium out of the main assembly of the apparatus A. Further, the image forming apparatus A is structured so that a process cartridge B (which hereafter may be referred to simply as cartridge B), is removably installable in the main assembly of the apparatus A.

Figure 2:
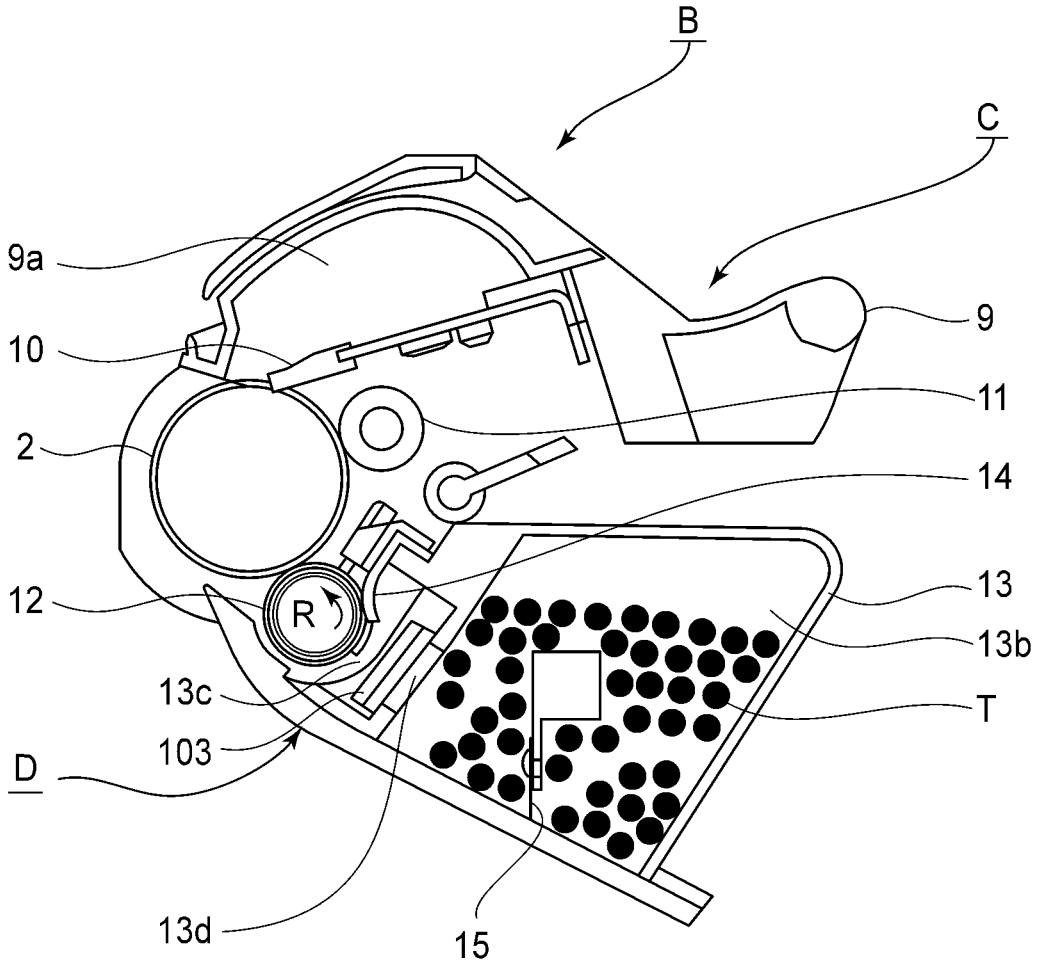
FIG. 2 is a schematic sectional view of the process cartridge in the first embodiment, and shows the general structure of the cartridge.

Next, referring to FIG. 2, the cartridge B is described. FIG. 2 is a schematic sectional view of the cartridge B, and shows the general structure of the cartridge B. The cartridge B consists of two primary units, that is, a cleaning unit C, and a development unit D (as developing device). The cleaning unit C has: an electrophotographic photosensitive member 2 (which hereafter may be referred to simply as photosensitive drum) as an image bearing member; a cleaning unit frame 9, a cleaning blade 10, and a charge roller 11. The photosensitive drum 2 and charge roller 11 are rotatably supported in contact with each other, by the frame 9. The cleaning blade 10 is attached to the frame 9 in such a manner that its cleaning edge remains in contact with the peripheral surface of the photosensitive drum 2. Further, the cleaning unit frame 9 is provided with a waste toner container 9*a* in which the waste toner, that is, the toner removed from the peripheral surface of the photosensitive drum 2 by the cleaning blade 10, is stored.

The development unit D has a developer bearing member 12, a development unit frame 13, a development blade 14, and a developer stirring member 15. The development unit frame 13 has: a developer storage chamber 13*b* in which toner T, which is developer, is stored; and a development chamber 13*c* in which the developer bearing member 12 is placed. The developer bearing member 12 is rotatably supported by the development unit frame 13. The development blade 14 is attached to the development unit frame 13, and is kept virtually in contact with the peripheral surface of the developer bearing member 12. The developer stirring member 15 is in the developer storage chamber 13*b*, and is rotatably supported by the development unit frame 13.

Further, the development unit frame 13 is provided with an opening 13*d* through which the developer storage chamber 13*b* is in connection to the development chamber 13*c*. Before the cartridge B is used for the first time, the developer delivery opening 13*d* of the development unit frame 13 is kept sealed with a sealing film 103, which is the first sealing member of the cartridge B, that is, the sealing member for keeping the developer delivery opening 13*c* sealed. More specifically, the sealing film 103 keeps the developer delivery opening 13*d* sealed by being welded to the development unit frame 13. The sealing film 103 is to be removed immediately before the cartridge B is used for the first time. As the sealing film 103 is removed, the toner T in the developer storage chamber 13*b* is allowed to be moved into the development chamber 13*c* by the developer stirring member 15 while being stirred by the stirring member 15.

Next, referring to FIGS. 1 and 2, the image forming operation of the image forming apparatus in this embodiment is briefly described. First, the charge roller 11 charges the peripheral surface of the photosensitive drum 2. Then, the laser scanner 1 exposes the charged portion of the peripheral surface of the photosensitive drum 2; the laser scanner 1 scans the charge portion of the peripheral surface of the photosensitive drum 2 with a beam L of laser light, which it emits while modulating the beam L with the electrical signals generated based on the information of the image to be formed. Consequently, an electrostatic latent image is formed on the peripheral surface of the photosensitive drum 2 (image bearing member).

Meanwhile, the stirring member 15 in the developer storage chamber 13*b* stirs the toner T in the developer storage chamber 13*b*. Thus, the toner T is conveyed to the developer bearing member 12 in the development chamber 13*c* through the developer delivery opening 13*d* of the development unit frame 13. Then, as the developer bearing member 12 rotates in the direction indicated by an arrow mark R in FIG. 2, the toner T is borne on the peripheral surface of the developer bearing member 12, forming a layer of the toner T (toner layer). Then, as the developer bearing member 12 is rotated further, the layer of the toner T on the peripheral surface of the developer bearing member 12 is conveyed the to the development blade 14 by the rotation of the developer bearing member 12. Then, as the developer bearing member 12 is rotated further, the layer of the toner T is regulated in thickness by the development blade 14 while being given a preset amount electrical charge. Consequently, a thin layer of the toner T, which has a preset thickness and a preset amount of electrical charge is formed on the peripheral surface of the developer bearing member 12. Then, the thin layer of the toner T is conveyed to the development area, that is, the area in which the distance between the peripheral surface of the photosensitive drum 2 and the peripheral surface of the developer bearing member 12 is smallest. The thin layer of toner T is conveyed through the area. While the thin layer of the toner T is conveyed through the development area, development bias is applied to the developer bearing member 12. Consequently, the toner T is supplied from the developer bearing member 12 onto the peripheral surface of the photosensitive drum 2, developing thereby the electrostatic latent image on the peripheral surface of the photosensitive drum 2 into a visible image, that is, an image formed of the toner T (which hereafter will be referred to as toner image).

Meanwhile, sheets M of recording medium such as paper, OHP film, fabric, or the like, which are in the sheet feeder cassette 3, are fed into the main assembly of the image forming apparatus A, while being separated one by one from the rest, by the combination of the pickup roller 4 and sheet pressing member 5. Then, each sheet M of recording medium is conveyed to the transfer roller 6 while being guided by the sheet conveyance guide (unshown). Then, the toner image on the photosensitive drum 2 is transferred onto the sheet M of recording medium by the transfer roller 6. The toner remaining on the peripheral surface of the photosensitive drum 2 after the transfer is removed, as waste toner, by the cleaning blade 10, and is stored in the waste toner container 9*a*.

After the transfer of the toner image onto the sheet M of recording medium, the sheet M is conveyed to the fixing device 7 along the recording medium conveyance guide, and is conveyed through the fixing device 7. As the sheet M is conveyed through the fixing device 7, the driving roller 7*a* and fixation roller 7*b* of the fixing device 7 apply heat and pressure to the sheet M and the toner image thereon. Consequently, the toner image is fixed to the surface of the sheet M. Thereafter, the sheet M is conveyed to the pair of discharge rollers 8, and is discharged from the image forming apparatus A by the pair of discharge roller 8, ending thereby the image formation operation of the image forming apparatus A.

(Structural Arrangement for Attaching Sealing Film)

Figure 3:
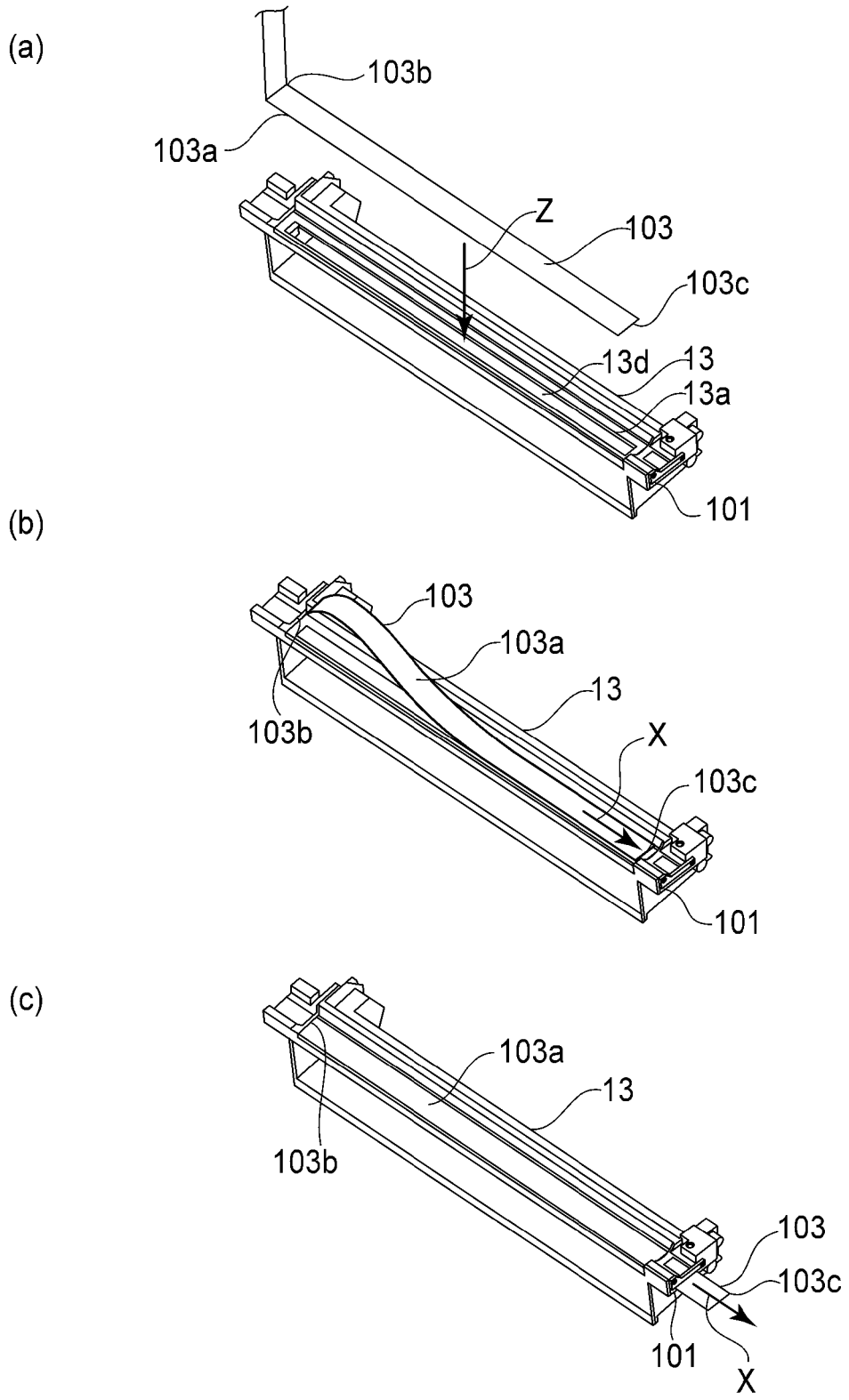
FIGS. 3(*a*), 3(*b*) and 3(*c*) are perspective views of the development unit frame of the cartridge, and sequentially shows how the sealing film is attached to the development unit frame.

Next, referring to FIG. 3, the structural arrangement, in this embodiment, for attaching the sealing film 103 to the development unit frame 13 is described. FIG. 3 is a perspective view of the development unit frame 13 of the cartridge B. It sequentially shows how the sealing film 103 is attached to the development unit D. More specifically, FIGS. 3(*a*), 3(*b*) and 3(*c*) are schematic perspective views of the development unit frame 13 before, during, and after the attachment of the sealing film 103 to the development unit frame 13, respectively.

Referring to FIG. 3(*a*), the sealing film 103 is welded to the rim of the developer delivery opening 13*d* of the development unit frame 13. Here, the portion of the sealing film 103, by which the sealing film 103 is welded to the development unit frame 13, is referred to as the rim surface 103*a* of the developer delivery opening 13*d*. Next, referring to FIG. 3(*b*), after the welding of the sealing film 103 to the development unit frame 13, the sealing film 103 is doubled back in the direction indicated by an arrow mark X at the double-back point (opposite end of development unit frame 13 from where sealing film extraction slit 101 is present), all the way to the lengthwise end where sealing film extraction slit 101 is present, and is extended through the sealing film extraction slit 101 so that the leading end portion 103*c*, in terms of the direction in which the sealing film 103 is doubled back, extends outward from the development unit frame 13, as shown in FIG. 3(*c*). This is how the sealing film 103 is attached (welded) to the development unit frame 13 to seal the developer delivery opening 13*d*.

Embodiment 1

Structure of Sealing Member

Figure 4:
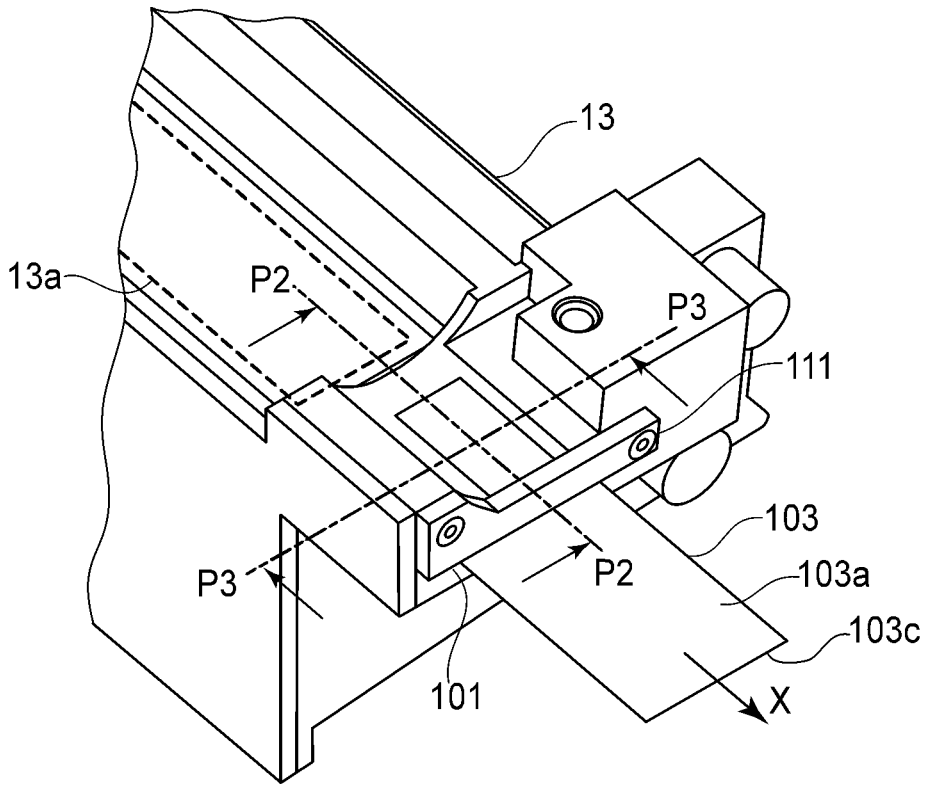
FIG. 4 is a perspective view of the lengthwise end portion of the cartridge in the first embodiment, from which the sealing film of the cartridge is to be pulled out. It shows the state of the lengthwise end portion of the cartridge before the cartridge is used for the first time.
Figure 5:
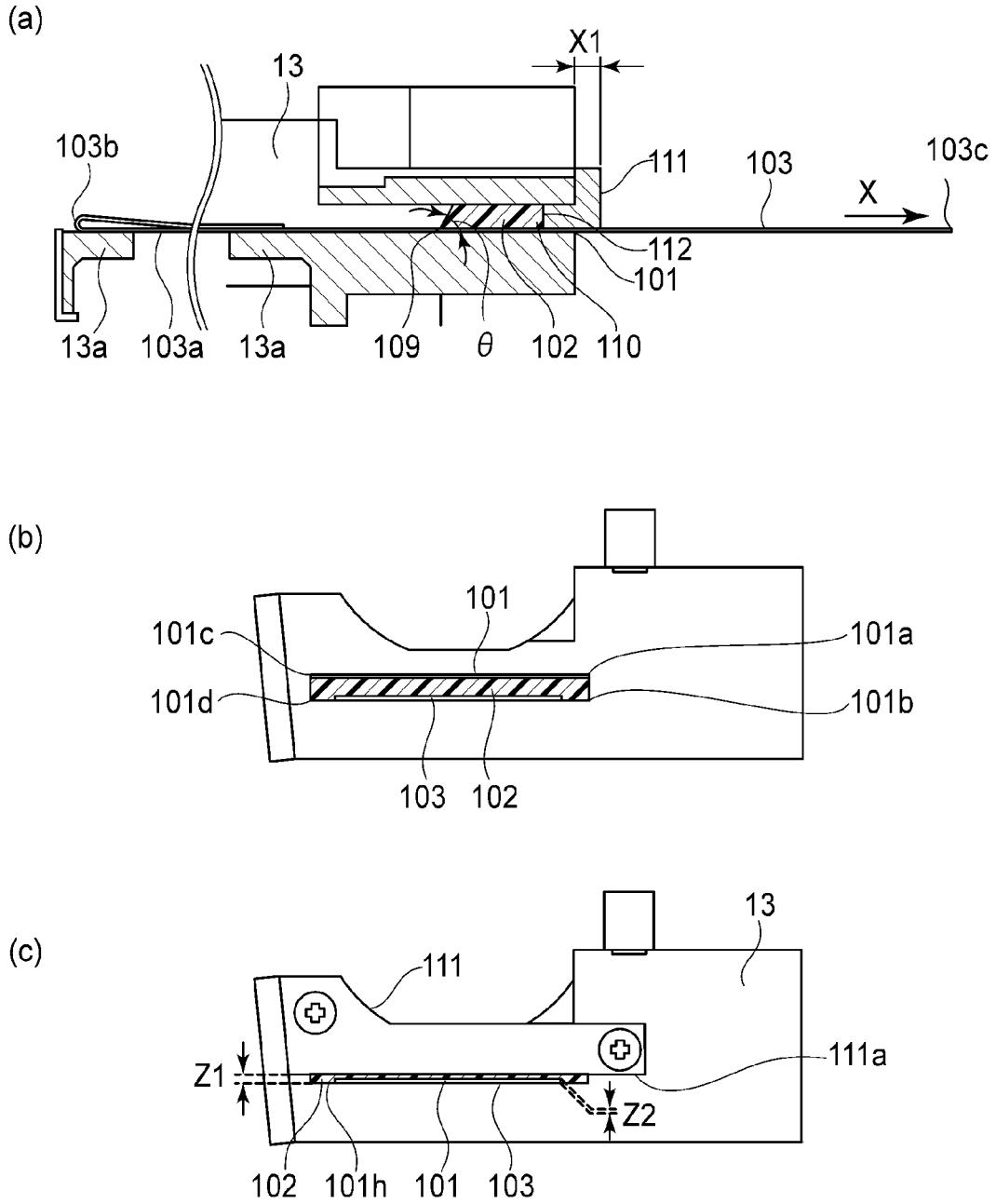
FIG. 5(*a*) is a schematic sectional view of the process cartridge in the first embodiment of the present invention, at a plane perpendicular to the recording medium conveyance direction of the cartridge.

Next, referring to FIGS. 4 and 5, the sealing member 102 in the first embodiment is described. The sealing member 102 is the second sealing member of the development unit frame 13. More specifically, the sealing member 102 is for plugging the sealing film extraction slit 101 to prevent the developer in the cartridge B from leaking out through the sealing film extraction slit 101. The details of the sealing member 102 will be given later.

FIG. 4 is a perspective view of the lengthwise end portion of the cartridge B in the first embodiment, from which the sealing film 103 is extended outward from the cartridge B through the sealing film extraction slit 101, before the cartridge is used for the first time (before sealing film is removed). FIG. 5 is a schematic sectional view of the sealing member and its adjacencies (part of developer unit frame 13) of the cartridge B, in the first embodiment, which is for describing the sealing member 102. More specifically, FIG. 5(*a*) is a schematic sectional view of the sealing member 102 and its adjacencies of the development unit frame 13 in the first embodiment, at a vertical plane which coincides with the line P2 in FIG. 4, which is parallel to the lengthwise direction of the cartridge B. It is for describing the sealing member 102. FIG. 5(*b*) is a schematic sectional view of the sealing member and its adjacencies of the development unit frame 13 in the first embodiment, at a vertical plane which coincides with the line P3-P3 in FIG. 4, which is parallel to the lengthwise direction of the cartridge B. It is for describing the sealing member 102. FIG. 5(*c*) is a side view of the development unit frame 13 as seen from the opposite direction from the direction indicated by the arrow mark X. Incidentally, the developer bearing member 12 and development blade 14, etc., are not shown in FIG. 5 for the sake of making it easier to describe the sealing member 102.

Before the cartridge B is used for the first time (before sealing film is removed), the developer delivery opening 13*d* remains sealed by the sealing film 103 welded to the development unit frame 13. In other words, the developer storage chamber 13*b* remains hermetically sealed. Thus, the toner T in the developer storage chamber 13*b* has not been delivered to the development chamber 13*c*. When the cartridge B is in the above described state, the end portion 103*c* of the sealing film 103 extends in the direction indicated by the arrow mark X through the sealing film extraction slit 101 as shown in FIG. 4.

The development unit D in the first embodiment is provided with the development unit sealing member 102 (which hereafter will be referred to simply as sealing member 102), which is for preventing the toner T in the developer storage chamber 13*b* from leaking out through the sealing film extraction slit 101. The sealing member 102 is formed in the sealing film extraction slit 101 by filling the sealing film extraction slit 101 with thermoplastic elastomer. Thus, as the thermoplastic elastomer is filled into the sealing film extraction slit 101, the sealing member 102 is formed like an integral part of the development unit frame 13. More specifically, the sealing film extraction slit 101 is filled with thermoplastic elastomer from one end 101*a* to the other 101*c* of the slit 101 in terms of the direction perpendicular to the lengthwise direction of the cartridge B. Thus, the resultant sealing member 102 fills the sealing film extraction slit 101 with the presence of no gap between itself and development unit frame 13, and also, between itself and sealing film 103, as shown in FIG. 5(*b*).

Referring to FIG. 5(*a*), the most upstream end portion of the sealing member 102 in terms of the direction (indicated by arrow mark X) in which the sealing film 103 is extracted is provided with a sealing film scraping portion 109 for scraping away the toner T having adhered to sealing film 103. A referential code θ in FIG. 5(*a*) stands for the angle of contact between the upstream surface of the sealing member 102, and the surface of the sealing film 103, which is in contact with the sealing member 102. In this first embodiment, the sealing member 102 is formed so that the angle θ of contact becomes no more than 90° as shown in FIG. 5(*a*).

Next, referring to FIGS. 5(*a*) and 5(*b*), the development unit frame 13 is provided with a sealing member retaining member 111. The upstream end 112 of this retaining member 111, in terms of the direction (indicated by arrow mark X) in which the sealing film 103 is to be extracted, is in contact with the downstream end 110 of the sealing member 102. Thus, it does not occur that the sealing member 102 comes out of the sealing film extraction slit 101.

Next, referring to FIG. 5(*c*), the sealing member retaining member 111 is shaped so that its retaining portion 112 (upstream end portion) fits into the sealing film extraction slit 101, and also, so that it can be solidly attached to the development unit frame 13 with small screws. However, attaching the sealing member retaining member 111 to the development unit frame 13 as shown in FIG. 5(*a*) increases the dimension of the cartridge B by an amount equal to the width X1 of the sealing member retaining member 111. Further, a gap Z1 through which the sealing film 103 is extracted from the development unit frame 13 is provided between the bottom surface 111*a* of the sealing member retaining member 111 and the bottom surface 101*h* of the sealing member extraction slit 101. In order to ensure that the sealing film 103 can be extracted through this gap Z1, the sealing member retaining member 111 is formed so that the dimension of the gap Z in terms of the direction perpendicular to the bottom surface of the retaining member 111 is greater than the thickness Z2 of the sealing film 103.

(Process for Forming Sealing Member)

Figure 6:
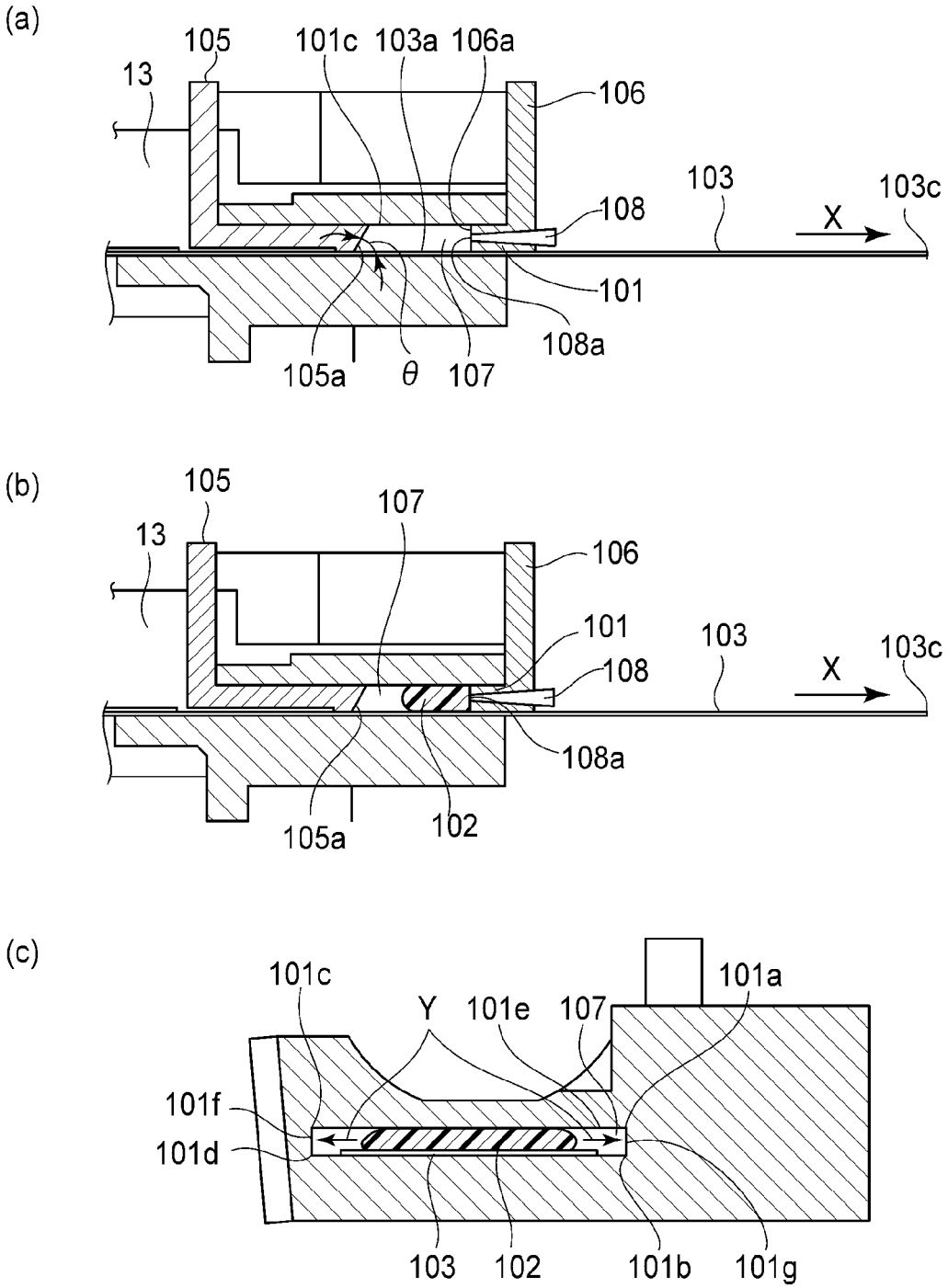
FIGS. 6(*a*), 6(*b*) and 6(*c*) are drawings for describing the process for forming the sealing member in the first embodiment.
Figure 7:
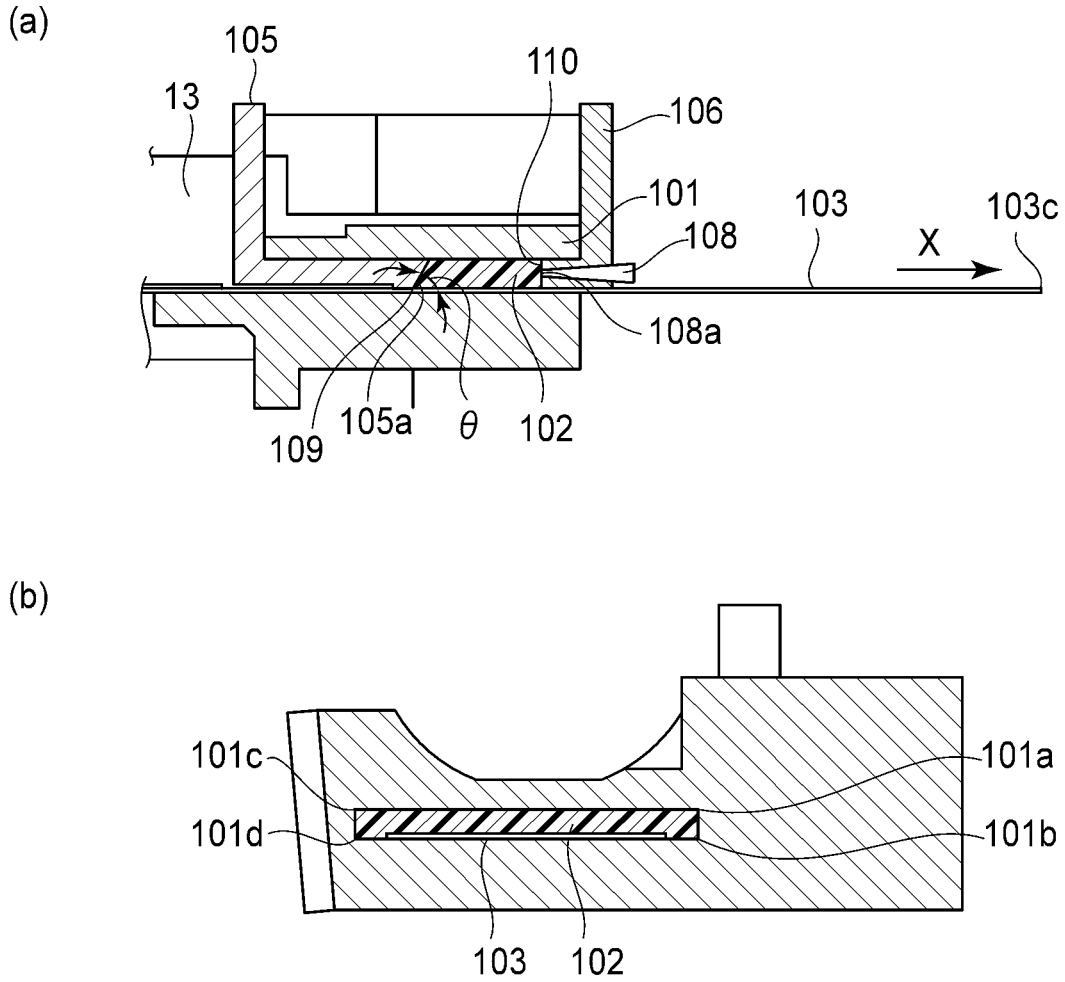
FIGS. 7(*a*) and 7(*b*) are drawings for describing the process for forming the sealing member in the first embodiment.
Figure 8:
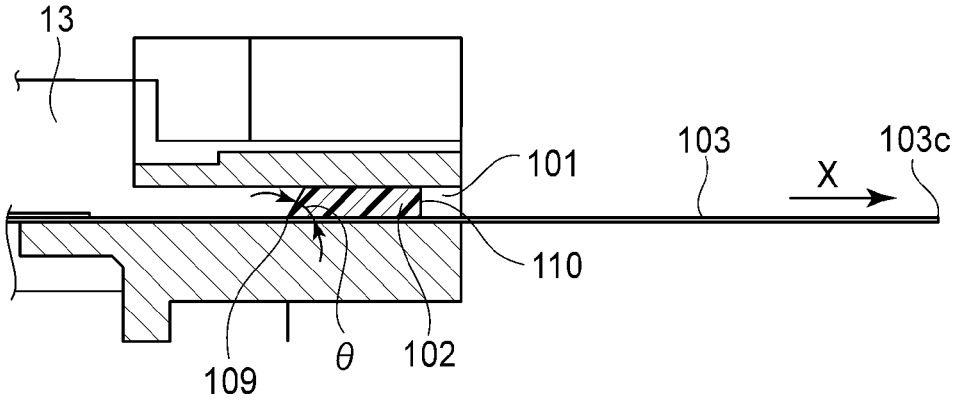
FIGS. 8(*a*) and 8(*b*) are drawings of the development unit immediately after the removal of the metallic molds from the development unit frame of the process cartridge.
Figure 8:
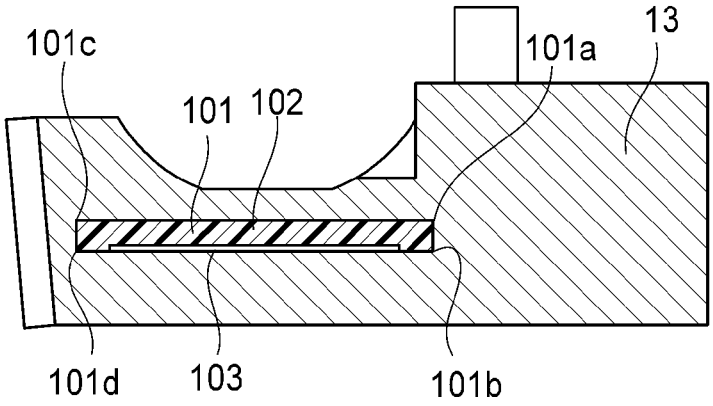

Next, referring to FIGS. 6-8, the process for forming the sealing member 102 in this embodiment is described. FIGS. 6 and 7 are drawings which show the process through which the sealing member 102 in this embodiment is formed. More specifically, FIGS. 6(*a*), 6(*b*), and 7(*a*) are schematic sectional views of the sealing member 102 (or space for sealing member 102) and its adjacencies, at a vertical plane which coincides with the line P2-P2 in FIG. 4. FIGS. 6(*c*) and 7(*b*) are schematic sectional views of the sealing member 102 in this embodiment, at a vertical plane which coincides with the line P3-P3 in FIG. 4. FIG. 8 is a schematic sectional view of the sealing member 102 and its adjacencies, after the removal of the first and second metallic molds after the injection molding of the sealing member 102. More specifically, FIG. 8(*a*) is a schematic sectional view of the sealing member 102 at the vertical plane which coincide with the lines P2-P2 in FIG. 4, and FIG. 8(*b*) is a schematic sectional view of the sealing member 102, at the vertical plane which coincides with the line P3-P3 in FIG. 4, as seen from the opposite direction from the direction indicated by the arrow mark X in FIG. 4.

In the first embodiment, the sealing member 102 is formed in the sealing film extraction slit 101 by injecting thermoplastic elastomer into the sealing film extraction slit 101 after the attachment (welding) of the sealing film 103 to the development unit frame 13. More concretely, referring to FIG. 6(*a*), first, in order to remove slack from the sealing film 103 by tensioning the sealing film 103, force is applied to the end portion 103*c* of the sealing film 103 in the direction indicated by the arrow mark X by an amount which is sufficient to tighten the sealing film 103, but, is not large enough to cause the sealing film 103 to be peeled from the development unit frame 13. Then, the first and second metallic molds 105 and 106 are inserted into the sealing film extraction slit 101 while keeping the sealing film 103 tensioned. Thus, a space 107 (mold) for forming the sealing member 103 is formed in the sealing film extraction slit 101 by the first and second metallic molds 105 and 106, sealing film 103, and development unit frame 13.

Next, referring to FIGS. 6(*a*) and 6(*b*), the first metallic mold 105 has a surface 105*a* which is for forming the above-mentioned sealing member formation space 107, more specifically, for forming the sealing film scraping portion (edge) of the sealing member 102. The first metallic mold 105 is shaped so that the angle θ between this surface 105*a* for forming the sealing film scraping portion of the sealing member 102, and the sealing film 103 becomes no more than 90°. The second metallic mold 106 is provided with a surface 106*a*, which is for forming the abovementioned sealing member formation space 107, more specifically, for forming the surface of the sealing member 102, which comes into contact with the sealing member retaining member 111. Next, referring to FIG. 6(*c*), designated by a referential code 101*e* is the top surface of the sealing film extraction slit 101, that is, the opposite surface of the sealing film extraction slit 101 from the surface of the sealing film extraction slit 101, which is in contact with the sealing film 103. In other words, the sealing member formation space 107 is formed by the surface 105*a* for forming the sealing film scraping portion of the sealing member 102, surface 106*a* for forming the surface of the sealing member 102, which comes into contact with the sealing member retaining member 111, top surface 101*e* of the sealing film extraction slit 101, surface 103*a* of the sealing film 103, which faces upward, first lateral surface 101*f* of sealing film extraction slit 101, and second lateral surface 101*g* of sealing film extraction slit 101.

Referring to FIG. 6(*a*), the second metallic mold 106 is provided with an injection nozzle 108 for injecting thermoplastic elastomer into the sealing member formation space 107, in the opposite direction from the direction indicated by the arrow mark X; thermoplastic elastomer is flowed into the sealing member formation space 107 from the tip 108*a* of the injection nozzle 108, as shown in FIG. 6(*b*). As the thermoplastic elastomer is injected into the sealing member formation space 107, it flows in the direction indicated by the arrow mark Y, into the corners 101*a*-101*d* of the sealing member formation space 107 in the sealing film extraction slit 101, while filling up the sealing member formation space 107, as shown in FIG. 6(*c*).

Consequently, the sealing member 102 is formed in the sealing member formation space 107, leaving no gap between itself and the aforementioned surfaces (surrounding walls) as shown in FIGS. 7(*a*) and 7(*b*). That is, even if the corners 101*a*-101*d*, etc., of the sealing member formation space 107 in the sealing film extraction slit 101 are imperfect in shape (superficial texture) because of manufacture errors and the like, thermoplastic elastomer is filled into the sealing member formation space 107 in a manner to accommodate the imperfections. In other words, in the first embodiment, the sealing member 102 is formed in the sealing member formation space 107, leaving no gap between itself and the walls of the sealing member formation space 107, as if it becomes an integral part of the development unit frame 13. That is, the sealing member 102 is enabled to remain stable in shape, as shown in FIGS. 8(*a*) and 8(*b*), even after the removal of the first and second metallic molds 105 and 106.

Incidentally, it is desired that the primary monomer among the monomers of which the development unit frame 13 is formed is included in the material for the sealing member 102. That is, it is desired that the thermoplastic elastomer as the material for the sealing member 102 is similar in properties to the material for the development unit frame 13, for the reason that in a case where the material for the sealing member 102 is similar in properties to the material for the development unit frame 13, the sealing member 102 does not need to be separated from the development unit frame 13 when recycling the used cartridge B as the thermoplastic material. In the first embodiment, the development unit frame 13 is formed of high impact polystyrene, and the sealing member 102 is formed of thermoplastic elastomer, the primary ingredient of which is styrene. However, this embodiment is not intended to limit the present invention in terms of the material for the sealing member 102. That is, the present invention is compatible with any sealing member (102) as long as the sealing member is similar in mechanical properties to the sealing member 102 in this embodiment, even if the sealing member (102) is different in material (resin) from the sealing member 102 in this embodiment.

(Function of Sealing Member)

Next, referring to FIG. 8, the function of the sealing member 102 in this embodiment is described. Before the cartridge B is used for the first time, the developer delivery opening 13*d* of the development unit frame 13 remains sealed with the sealing film 103. Thus, the portion of the surface of the sealing film 103, which has been facing the developer storage chamber 13*b* is covered with toner T. When the cartridge B is used for the first time, the sealing film 103 has to be removed by a user; as the sealing film 103 is pulled by the user, by the end portion 103 of the sealing film 103, which is exposed from the development unit frame 13 through the sealing film extraction slit 101, in the direction indicated by the arrow mark X as shown in FIG. 8(*a*), the sealing film 103 comes out of the development unit frame 13 through the sealing film extraction slit 101. As the sealing film 103 welded to the development unit frame 13 is pulled, the sealing film 103 gradually peels away from the development unit frame 13, starting from its double-back point 103*b*. As the sealing film 103 peels away, the portion 103*a* of the surface of the sealing film 103, which was facing inward of the developer storage chamber 13*b*, and therefore, is covered with the toner T, rubs against the sealing film scraping portion (edge) 109 of the sealing member 102, whereby the toner T on the sealing film 103 is scraped away from the film 103. Therefore, it does not occur that as the sealing film 103 is pulled out of the development unit frame 13 through the sealing film extraction slit 101, the toner T having adhered to the sealing film 103 leaks from (comes out of) the development unit frame 13.

Figure 9:
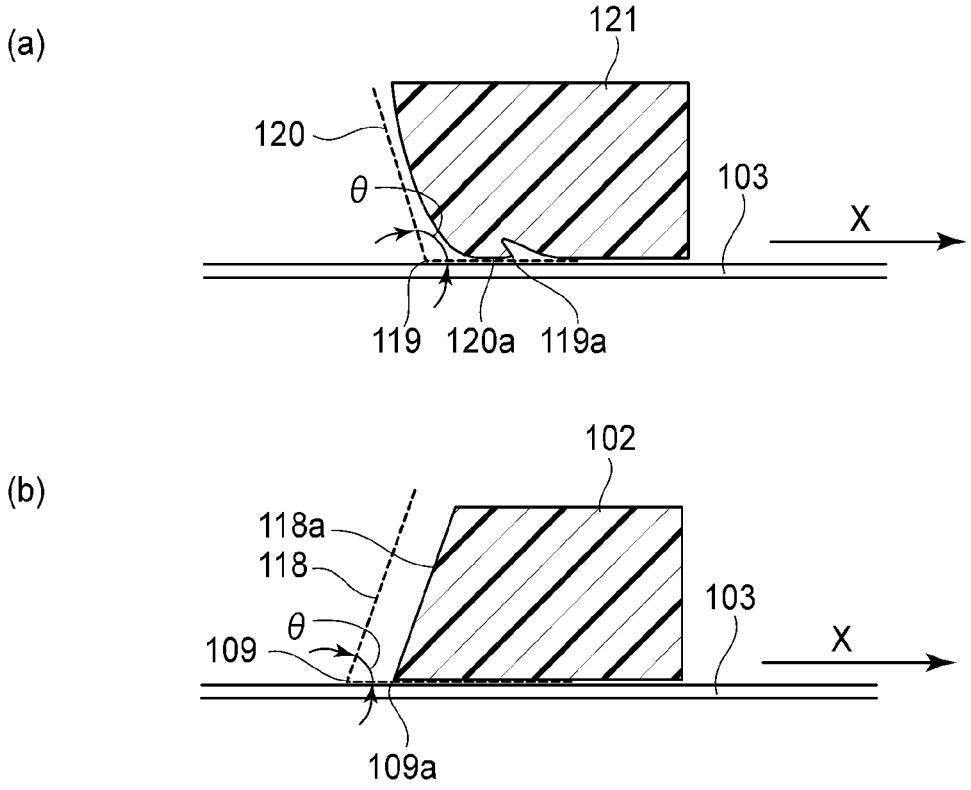
FIGS. 9(*a*) and 9(*b*) are drawings for describing the difference in developer removal performance between a sealing member, the sealing edge of which makes an obtuse angle with the sealing film, and a sealing member, the sealing edge of which makes an acute angle with the sealing film.

Next, referring to FIG. 9, how the toner T on the sealing film 103 is scraped away is described. FIG. 9 is a drawing for describing the function of the sealing member 102 in terms of scraping away the toner T on the sealing film 103. FIG. 9(*a*) is an enlarged schematic sectional view of the sealing film scraping portion (edge) 119 (119*a*) of a sealing member 121, the angle θ of contact of which relative to the sealing film 103 is no less than 90° FIG. 9(*b*) is an enlarged schematic sectional view of the sealing film scraping portion 109 (109*a*) of the sealing member 102, the angle θ of contact of which relative to the sealing film 103 is no more than 90°, that is, the sealing film scraping portion of the sealing member 102 in this embodiment. In FIG. 9, the dotted lines indicate the contours of the sealing members 120 and 102 before the sealing film 103 begins to be pulled in the direction indicated by the arrow mark X, whereas the hatched areas indicate the shape of the sealing members 120 and 102 after the sealing film 103 began to be pulled in the arrow X direction. Referring to FIG. 9(*a*), a referential code 120 stands for the upstream surface of the sealing member 102 in terms of the direction in which the sealing film 103 is extracted, and a referential code 119 stands for the film scraping portion (scraping edge) of the sealing member 102. Further, referential codes 119*a* and 120*a* stand for the film scraping portion (edge) and upstream surface 120*a* of the sealing member 121 after the sealing film 103 began to be pulled in the direction of the arrow mark X.

As the sealing film 103 is pulled in the direction of the arrow mark X by the tension applied to the sealing film 103 in order to extract the sealing film 103, the sealing film scraping portion 109 is subjected to the shearing stress generated between the sealing film scraping portion 109 and sealing film 103. Referring to FIG. 9(*a*), if the angle θ of contact between the sealing film scraping portion 119 and sealing film 103, that is, the angle between the upstream surface 120 and sealing film 103, is no less than 90°, the sealing film scraping portion 119 of the sealing member 121 buckles downstream in terms of the direction in which the sealing film 103 is pulled. As the sealing film scraping portion 119*a* buckles as described above, the upstream surface 120*a* of the sealing member 121 comes into contact with the sealing film 103. Hereafter, this phenomenon will be referred to as "belly buckling", of the sealing member 121. As the "belly-buckling" occurs to the sealing film scraping portion 119*a* of the sealing member 121, the sealing film scraping portion (edge) 119*a* stops contacting the sealing film 103. Consequently, the sealing member 103 reduces in performance in terms of its function of scraping away the toner T from the sealing film 103. In other words, the sealing member 121 fails to completely scrape away the toner T having adhered to the sealing film 103.

In comparison, referring to FIG. 9(*b*), in the case of the sealing member 102 in this embodiment, which is no more than 90° in the angle θ of contact between its sealing film scraping portion 109 and the sealing film 103, the shearing stress friction between the sealing film scraping portion 109 and sealing film 103 works in the direction of pressing the sealing film scraping portion 109 toward the upstream surface 118 of the sealing member 102. Therefore, it does not occur that the sealing film scraping portion 109 buckles downstream. That is, in the case of the sealing member 102 in this embodiment, its sealing film scraping portion 109 does not buckle downstream when the sealing film 103 is extracted from the development unit frame 13. In other words, the "belly buckling" does not occur. Therefore, the sealing film scraping portion (edge) 109*a* of the sealing member 102 in this embodiment remains perfectly in contact with the sealing film 103; the sealing member 102 in this embodiment remains stable in terms of its function of scraping the toner T having adhered to the sealing film 103.

As described above, in order for the sealing member 102 to be effective to prevent the toner T from leaking out of the development unit frame 13 through the sealing film extraction slit 101, the angle θ of contact between the sealing film scraping portion 109 of the sealing member 102 is desired to be no more than 90°.

Figure 10:
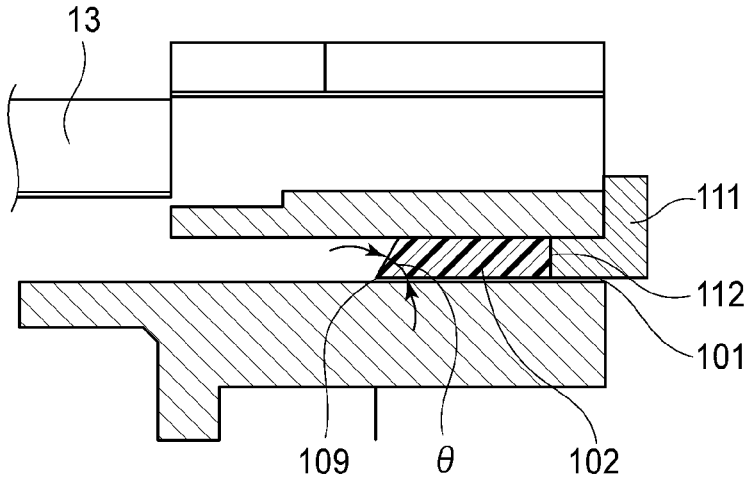
FIG. 10 is a schematic sectional view of the end portion of the development unit frame of the cartridge, which has the sealing film extraction slit. It shows the state of the sealing member after the removal of the sealing film.

Next, referring to FIG. 10, the state of the development unit frame 13 after the extraction of the sealing film 103 from the development unit frame 13 is described. FIG. 10 is a schematic sectional view of the sealing member 102 and its adjacencies, at the vertical plane which coincides with the line P2-P2 in FIG. 4, after the removal of the sealing film 103. It shows the state of the sealing member 102 after the removal of the sealing film 103. The sealing member 102 is kept in the sealing film extraction slit 101 even after the extraction of the sealing film 103 from the development unit frame 13, as shown in FIG. 10. Therefore, it can prevent the toner T from leaking through the sealing film extraction slit 101 even while the cartridge B is being used for image formation.

As described above, in the first embodiment, the problem that the toner T leaks from the development unit frame 13 through the sealing film extraction slit 101 is prevented with the use of the sealing member 102. Further, the sealing member 102 in the first embodiment is formed in such a manner that as it is formed, it becomes a virtually integral part of the development unit frame 13. Therefore, it is ensured that the toner T having adhered to the sealing film 103 is satisfactorily scraped away by the sealing member 102.

(Comparison of Sealing Member in First Embodiment with Sealing Member Different in Structure from Sealing Member in First Embodiment)

Figure 22:
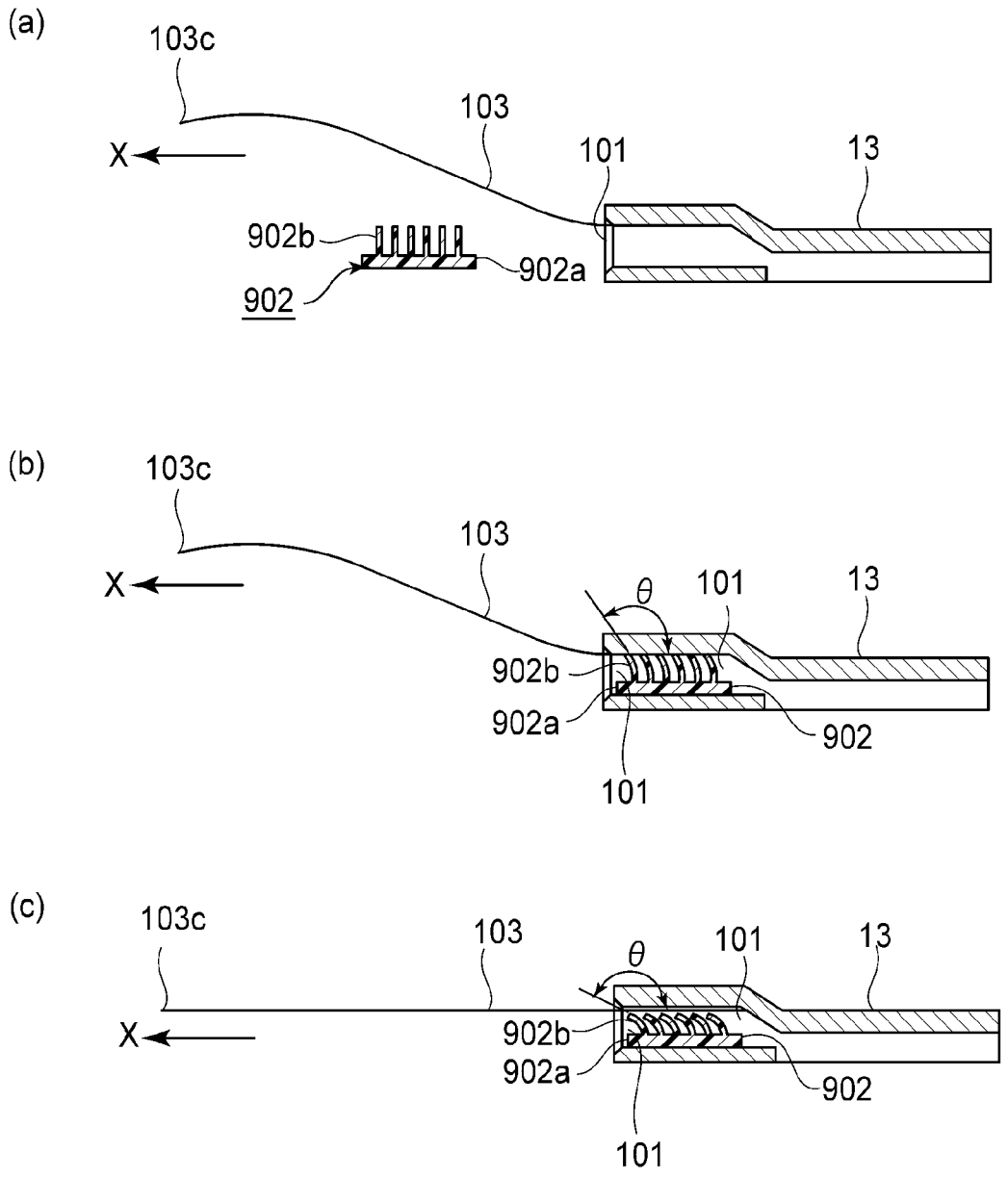
FIGS. 22(*a*), 22(*b*) and 22(*c*) are sectional views of the portion of the development unit frame of the comparative process cartridge, which has the sealing film extraction slit and sealing member. They sequentially show the portion before, during, and after the insertion of the sealing member into the sealing film extraction slit.

Here, in order to verify the effectiveness of the sealing member 102 in the first embodiment of the present invention, the sealing member 102 in this embodiment was compared with a comparative sealing member 902, which is shown in FIGS. 22(*a*), 22(*b*) and 22(*c*). The comparative sealing member 902 is different from the sealing member 102 in this embodiment in that it is formed before it is inserted into the sealing film extraction slit 101.

In the case where the sealing member extraction slit 101 of the development unit frame 13 is plugged with the abovementioned comparative sealing member 902, the sealing member 902, which has fins 902*b*, has to be inserted into the sealing film extraction slit 101 in such an attitude that the fins 902*b* come into contact with the sealing film 103. Thus, when the cartridge B (development unit frame 13) is assembled, the sealing member 902 has to be placed in the proper attitude.

Figure 23:
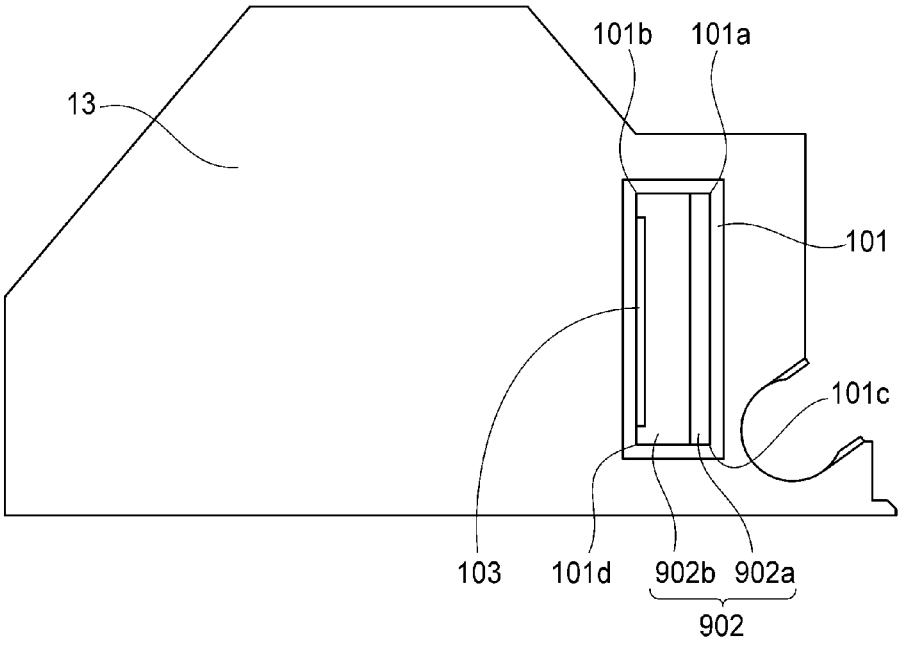
FIG. 23 is a drawing for describing the sealing member and development unit frame of the comparative process cartridge.

Moreover, in the case where the development unit frame 13 is structured so that the preformed sealing member 902 is to be inserted into the sealing film extraction slit 101 of the development unit frame 13, the process for manufacturing the sealing member 902 and sealing film extraction slit 101 have to be strictly controlled in terms of the measurement of the sealing member 902 and sealing film extraction slit 101, in order to ensure that the developer does not leak from the development unit frame 13 at the corner portions 101*a*-101*d* of the sealing film extraction slit 101 shown in FIG. 23. Thus, it is possible that using the preformed sealing member 902 to plug the sealing film extraction slit 101 and scrape the sealing film 103 adds to the cartridge cost.

In comparison, in the case where the development unit frame 13 and sealing member 102 are structured as they are in this embodiment, the process for inserting the sealing member 102 into the sealing film extraction slit 101 is unnecessary. In other words, the sealing member 102 in this embodiment is superior to the comparative sealing member 109 in terms of the productivity of the process of manufacturing the process cartridge B. Further, the sealing member 102 conforms to the shape of the sealing film extraction slit 101 as it is formed. Therefore, it does not need to be preformed with such an accuracy that it perfectly matches in measurement with the sealing film extraction slit 101. That is, the process for manufacturing the cartridge B (development unit frame 13) does not need to be strictly controlled in terms of the measurement of the sealing member 102 and sealing film extraction slit 101. Therefore, this embodiment can improve in productivity the process for manufacturing the cartridge B (development unit frame 13), and also, reduce the cartridge B (development unit frame 13) in cost.

Embodiment 2

Figure 11:
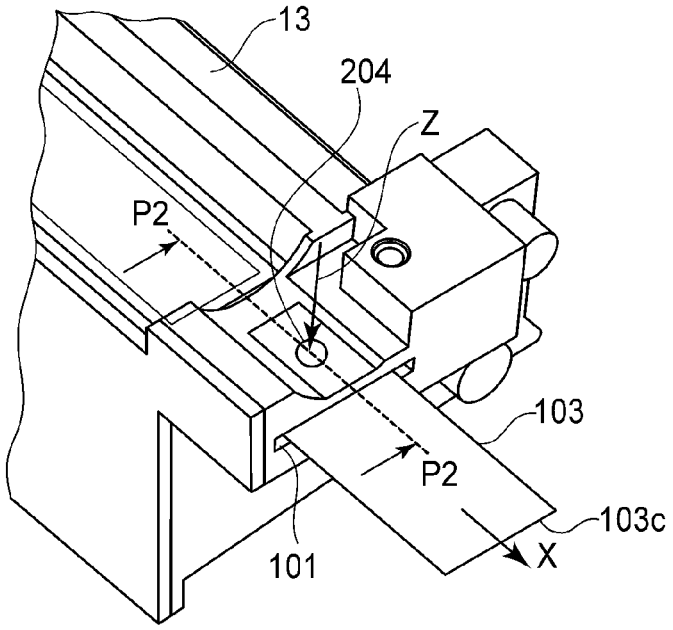
FIG. 11 is a perspective view of the end portion of the development unit frame of the cartridge in the second embodiment of the present invention, which has the sealing film extraction slit. It shows the state of the cartridge before the cartridge is used for the first time.
Figure 12:
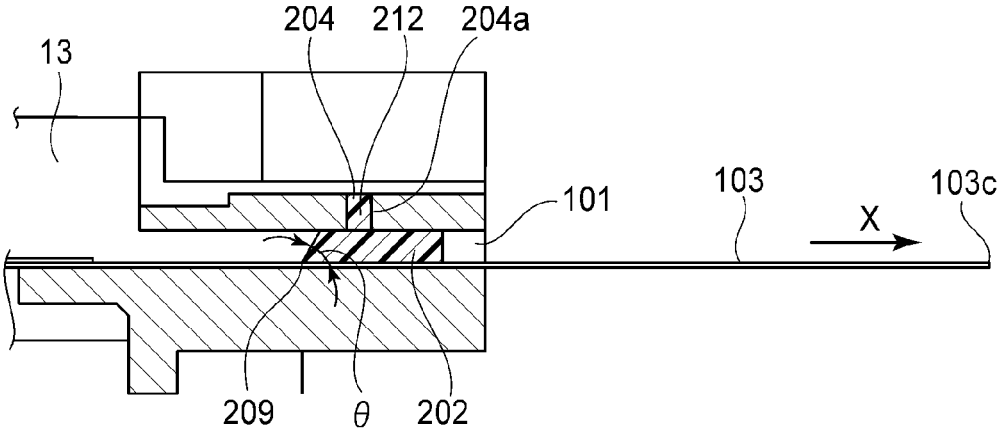
FIG. 12 is a schematic sectional view of the downstream end portion of the process cartridge in terms of the direction in which the sealing member is pulled out of the cartridge. It shows the structure of the sealing member in the second embodiment.

Next, referring to FIGS. 11 and 12, the development unit frame 13 and sealing member in the second embodiment of the present invention are described. FIG. 11 is a perspective view of the end portion of the development unit frame 13 in the second embodiment of the present invention, which has the sealing film extraction slit 101. It shows the end portion before the cartridge is used for the first time. FIG. 12 is a schematic sectional view of the downstream end portion of the development unit frame 13 in terms of the direction in which the sealing film 103 is pulled out of the cartridge B, at the vertical plane which coincides with the line P2-P2 in FIG. 11. It shows the structure of the sealing member in the second embodiment. The components, portions, etc., of the development unit frame 13 in this embodiment, which are the same in structure as the counterparts in the first embodiment, are given the same referential codes as those given to the counterparts, and are not going to be described here.

Referring to FIG. 11, in the second embodiment, the sealing film 103 is welded (adhered) to the development unit frame 13 to cover the developer delivery opening 13*d* of the development unit frame 13, and is doubled back at the opposite end of the developer delivery opening 13*d* from the sealing film extraction slit 101, extended to the sealing film extraction slit 101, and extended out of the development unit frame 13 by a preset length, through the sealing film extraction slit 101, in the direction indicated by an arrow mark X, as in the first embodiment. Next, referring to FIG. 12, the sealing member 202 in the second embodiment is shaped so that the angle θ of contact becomes no more than 90° like that of the sealing member 102 in the first embodiment.

Referring to FIGS. 11 and 12, in the second embodiment, the development unit frame 13 is provided with an injection hole 204, which leads to the sealing member formation space which is to be filled with the material for the sealing member 102. Referring to FIG. 11, a line P2-P2 coincides with the center of the injection hole 204 and parallel to the lengthwise direction of the cartridge B. Referring to FIG. 12, designated by a referential code 202 is a sealing member formed by filling the sealing member formation space and injection hole 204 with the material for the sealing member 202. The portion of the sealing member 202, which is in the injection hole 204, will be referred to as a sealing member locking portion 212 (which hereafter may be referred to simply as locking portion 212). The locking portion 212 prevents the sealing member 102 from dropping out of the sealing film extraction slit 101 of the development unit frame 13.

Referring to FIG. 12, the sealing member locking portion 212, which is a part of the sealing member 202 is formed in the injection hole 204. When the sealing film 103 is pulled out of the development unit frame 13, the shearing stress generated between the sealing film scraping portion 209 and sealing film 103 acts on the sealing film scraping portion 209. That is, the sealing member 202 is pressed outward of the development unit frame 13 by this shearing stress. In the second embodiment, however, the sealing member locking portion 212 of the sealing member 202 comes into contact with the wall 204*a* of the injection hole 204, preventing thereby the sealing member 202 from being moved out of the sealing film extraction slit 101. That is, the injection hole 204 is a hole with which the development unit frame 13 is provided to regulate the movement of the sealing member 202; because the sealing member locking portion 212 of the sealing member 202 is in the injection hole 204, the sealing member 202 is prevented from moving.

Figure 13:
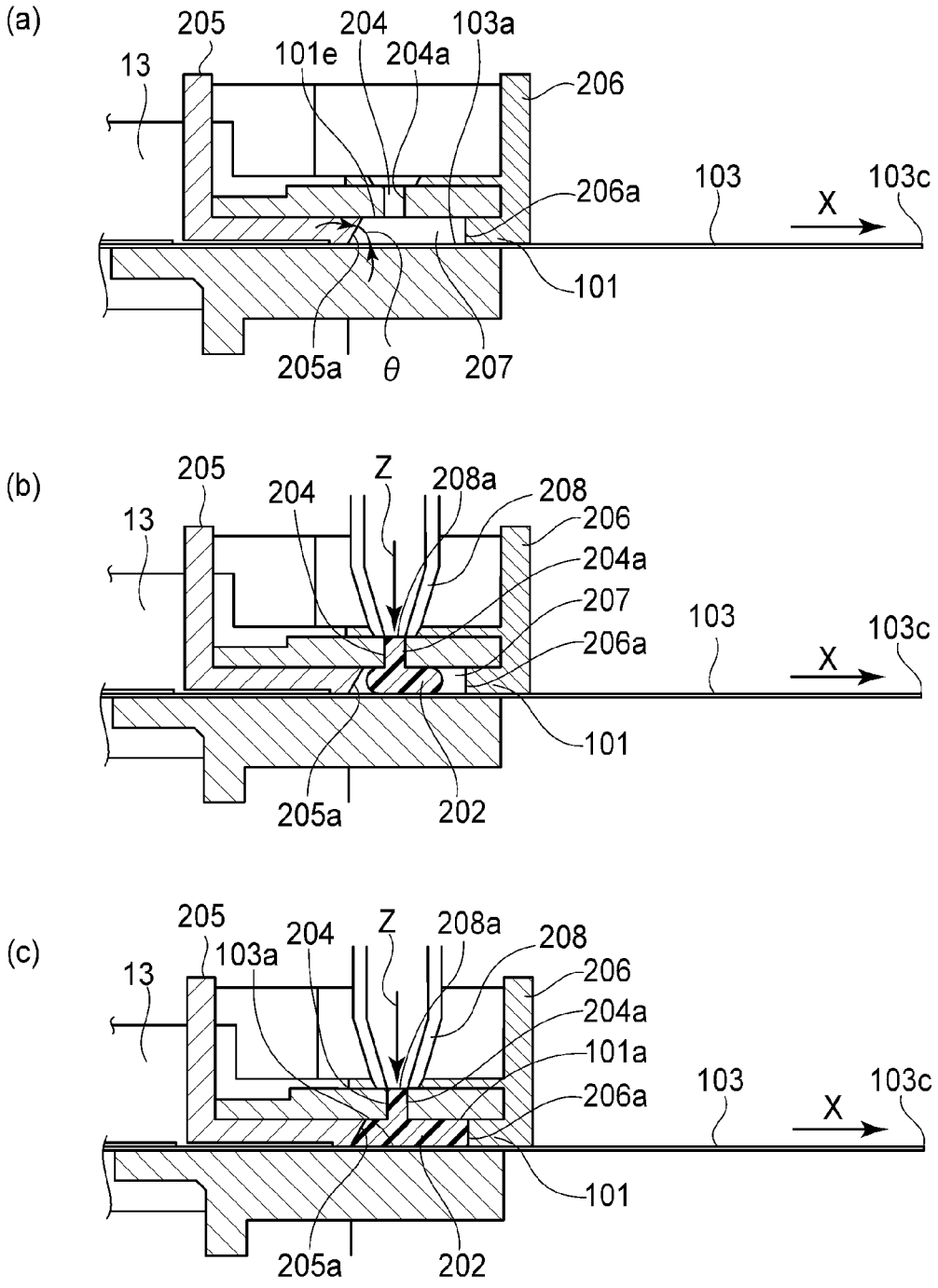
FIGS. 13(*a*), 13(*b*) and 13(*c*) are schematic sectional views of the downstream end portion of the second embodiment in terms of the sealing film extraction direction. They sequentially show the process through which the sealing member in the second embodiment is formed.

Next, referring to FIG. 13, the process for forming the sealing member 202 in the second embodiment is described. FIGS. 13(*a*), 13(*b*) and 13(*c*) are sectional views of the lengthwise end portion of the development unit frame 13, which has the sealing film extraction slit 101 and sealing member 202. They are for describing the process for forming the sealing member 202 in the second embodiment. Referring to FIG. 13(*a*), before the sealing member 202 is formed by injection molding, the sealing film 103, which has been welded to the development unit frame 13, is kept tensioned by a preset amount pressure applied to the outward end 103*c* of sealing film 103 in the direction indicated by an arrow mark X, while keeping sealed the developer delivery hole 13*d*. While the development unit frame 13 is kept in this state, the first and second metallic molds 205 and 206 are inserted into the sealing film extraction slit 101 to form the sealing member formation space (mold) 207. Referring also to FIG. 13(*a*), the sealing member formation space (mold) 207 is formed by the surface 205*a* for forming the sealing film scraping portion of the sealing member 202, surface 206*a* for forming the downstream end surface of the sealing member 202 in terms of the direction in which the sealing film 103 is extracted, top surface 101*e* of the sealing film extraction slit 101, surface 103*a* of the sealing film 103, which faces upward; first lateral surface 101*f* of sealing film extraction slit 101, second lateral surface 101*g* of sealing film extraction slit 101, and injection hole 204. Here, the first and second lateral surfaces 101*f* and 101*g* of the sealing film extraction slit 101 are the same as the counterparts in the first embodiment, which are shown in FIG. 6(*c*).

Referring to FIG. 13(*b*), as thermoplastic elastomer is injected through the injection nozzle 208 in the direction indicated by an arrow mark Z, thermoplastic elastomer is filled into the sealing member formation space 207 from the tip 208*a* of the injection nozzle 208. Next, referring to FIG. 13(*c*), as the thermoplastic elastomer is injected into the sealing member formation space 207, it fills up the sealing member formation space 207, forming the sealing member 202, leaving no gap between the sealing member 202 and the aforementioned surfaces. That is, the sealing member 202 is formed as a virtually integral part of the development unit frame 13.

As described above, in the second embodiment, the sealing member 202 is used to prevent the toner T from leaking through the sealing film extraction slit 101. Further, the sealing member 202 in the second embodiment is formed as a virtually integral part of the development unit frame 13. Therefore, it is ensured that the toner T having adhered to the sealing film 103 is satisfactorily scraped away by the sealing member 202. Further, the process for manufacturing the development unit frame 13 (cartridge B) does not need to be extremely precisely controlled in terms of the measurement of the sealing member 202 and sealing film extraction slit 101. Thus, this embodiment of the present invention also can improve in productivity the process for manufacturing the cartridge B, and reduce in cost the cartridge B. Further, the sealing member 202 in the second embodiment is provided with the sealing member locking portion 212, making unnecessary the sealing member retaining member 111 (which is independent from development unit frame 13) used in the first embodiment. Thus, the developer unit D (cartridge B) in the second embodiment is shorter by an amount equal to the width X1 of sealing member retaining member 111 (FIG. 5(*a*)), and also, is less in cost, than the development unit D (cartridge B) in the first embodiment.

Embodiment 3

Figure 14:
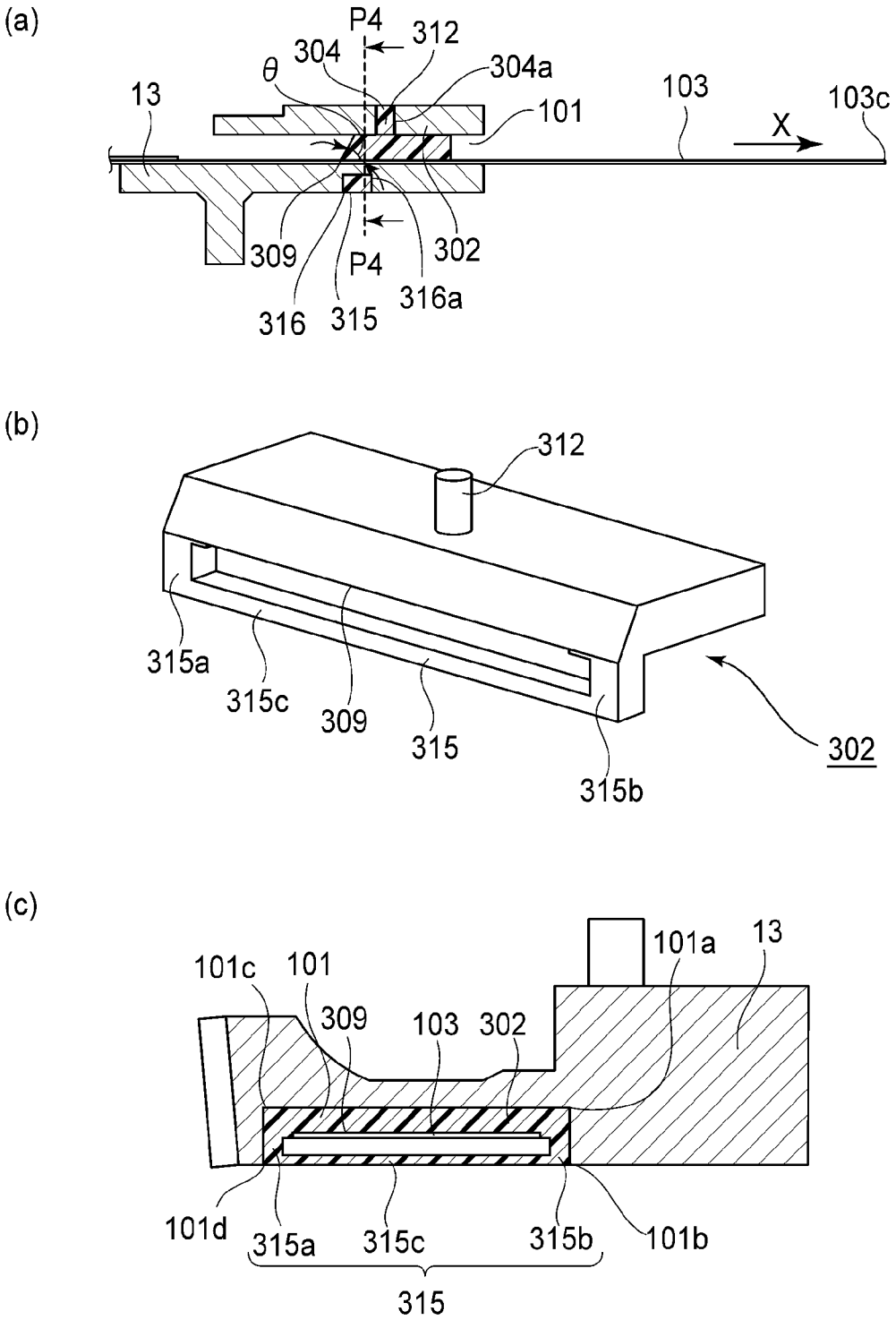
FIG. 14(*a*) is a schematic sectional view of the sealing member and its adjacencies of the development unit frame of the process cartridge in the third embodiment of the present invention, and shows the structure of the sealing member.

Next, referring to FIG. 14, the sealing member and development unit frame in the third embodiment of the present invention are described. FIGS. 14(*a*), 14(*b*) and 14(*c*) are drawings for describing the sealing member and development unit frame 13 in the third embodiment. More specifically, FIG. 14(*a*) is a schematic sectional view of the development unit frame 13 and sealing member in the third embodiment, and FIG. 14(*b*) is a schematic perspective view of the sealing member in the third embodiment. FIG. 14(*c*) is a schematic sectional view of the development unit frame 13 and sealing member in the third embodiment, at a vertical plane which coincides with a line P4-P4 in FIG. 14(*a*). The structural components, portions thereof, etc., of the development unit frame 13 and sealing member in the third embodiment, which are the same in structure as the counterparts in the first or second embodiment are given the same referential codes as those given to the counterparts, and are not going to be described here.

Referring to FIG. 14(*a*), in the third embodiment, the portion of the sealing film 103, which was not welded to the development unit frame 13 is doubled back (folded back) at the opposite end of the development unit frame 13 from where the sealing film extraction slit 101 is present, is laid on the portion of the sealing film 103, which is covering the developer delivery opening 13*d*, in the direction indicated by an arrow mark X, and is extended outward of the development unit frame 13 through the sealing film extraction slit 101, so that the end portion 103*c* of the sealing film 103 is exposed from the development unit frame 13, like the sealing film 103 in the first embodiment. Further, the sealing member 302 in the third embodiment also is shaped so that its angle θ of contact becomes no more than 90°, like the sealing member 102 in the first embodiment. Further, the sealing member 302 in the third embodiment is formed as a virtually integral part of the development unit frame 13, by injection molding thermoplastic elastomer, like the sealing member 102 in the first embodiment. Thus, the sealing member 302 in the third embodiment also occupies the sealing member formation space even to the corners 101*a*-101*d* of the sealing member formation space. In other words, thermoplastic elastomer fills the sealing member formation space (mold) to the corners 101*a*-101*d* of the sealing member formation space (mold), regardless of the imperfection in the surface texture of the surfaces (walls) which form the sealing member formation space; the resultant sealing member 302 fits in the sealing film extraction slit 101, with the presence of no gap between itself and the walls of the sealing film extraction slit 101.

Further, the sealing member 302 in this embodiment is directly molded into the sealing film extraction slit 101 and injection hole 304, in a manner similar to the manner in which the sealing member 202 in the second embodiment was directly molded into the sealing film extraction slit 101. Thus, the sealing member locking portion 312 of the sealing member 302, which is formed in the injection hole 304 can prevent the sealing member 302 from falling out of the development unit frame 13 through the sealing film extraction slit 101, because when the sealing film 103 is pulled out of the development unit frame 13 through the sealing film extraction slit 101, the sealing member locking portion 312 prevents the sealing member 302 from moving in the direction indicated by the arrow mark X, by coming into contact with the wall 304*a* of the injection hole 304.

Referring to FIG. 14, the sealing member 302 in the third embodiment has the sealing member locking second portion 315 in addition to the above described structural features. Referring to FIG. 14(*b*), the sealing member locking second portion 315 has end portions 315*a* and 315*b*, and bottom portion 315*c*. Next, referring to FIG. 14(*a*), the sealing member locking portion 315 is formed by injecting the thermoplastic elastomer into the through hole 316, which the development unit frame 13 is provided; the sealing member locking portion 315 is in the through hole 316. The sealing member locking portion 315 prevents the sealing member 302 from coming out of the sealing film extraction slit 101 when the sealing film 103 is pulled out of the development unit frame 13. Further, it is in contact with the side walls of the hole 316*a* of the development unit frame 13. Therefore, the reaction from the side wall surface 316*a* prevents the film scraping portion (edge) of the sealing member 302 from buckling downstream as shown in FIG. 9(*a*). In other words, the reaction prevents the angle θ of contact from being increased. Therefore, the sealing film scraping portion 309 can scrape the toner T, with its angle θ of contact relative to the sealing film 103 remaining to be no more than 90°. Thus, it is ensured that the toner T is satisfactorily scraped away when the sealing film 103 is pulled out of the development unit frame 13.

As described above, in the third embodiment, the sealing member 302 was used to prevent the toner T from leaking out of the development unit frame 13 through the sealing film extraction slit 101. Further, the sealing member 302 in the third embodiment is formed as a virtually integral part of the development unit frame 13. Therefore, it is ensured that the toner T having adhered to the sealing film 103 is satisfactorily scraped away by the sealing member 302. Further, the third embodiment makes it unnecessary to strictly control the process for manufacturing the development unit frame 13 (cartridge B) in terms of the measurement of the sealing member 302 and sealing film extraction slit 101. Thus, this embodiment of the present invention also can improve in productivity the process for manufacturing the cartridge B, and reduce in cost the cartridge B. Further, the sealing member 302 in the third embodiment is provided with the sealing member locking portion 312, making unnecessary the sealing member retaining member 111 (which is independent from development unit frame 13) used in the first embodiment. Thus, the development unit frame 13 in the third embodiment is shorter, and also, less in cost, than the development unit frame 13 in the first embodiment. Further, the sealing member 302 in the third embodiment has the sealing member locking second portion 315, which can prevent the angle θ of contact from increasing when the sealing film 103 is pulled out of the development unit frame 13. Therefore, it is ensured that the sealing member 302 in the third embodiment can satisfactorily scrape the toner T from the sealing film 103.

Embodiment 4

In the case of each of the first to third embodiments, in order to increase in efficiency the process for attaching the sealing member to the cartridge B, the sealing member is molded into the sealing film extraction slit 101 by injecting the thermoplastic elastomer into the sealing film extraction slit 101.

This embodiment is different from the preceding embodiments described above in that the sealing member 702 in this embodiment is molded before it is inserted into the sealing film extraction slit 101. That is, this embodiment is about how to simplify the process for assembling the cartridge B (development unit frame 13) which uses a preformed sealing member. The characteristic feature of this embodiment is that the sealing member locking member for preventing the sealing member 702 from coming out of the sealing film extraction slit 101 is formed as an integral part of the sealing member 702, although the details of the sealing member 702 will be described later.

(Structure of Sealing Member)

Figure 15:
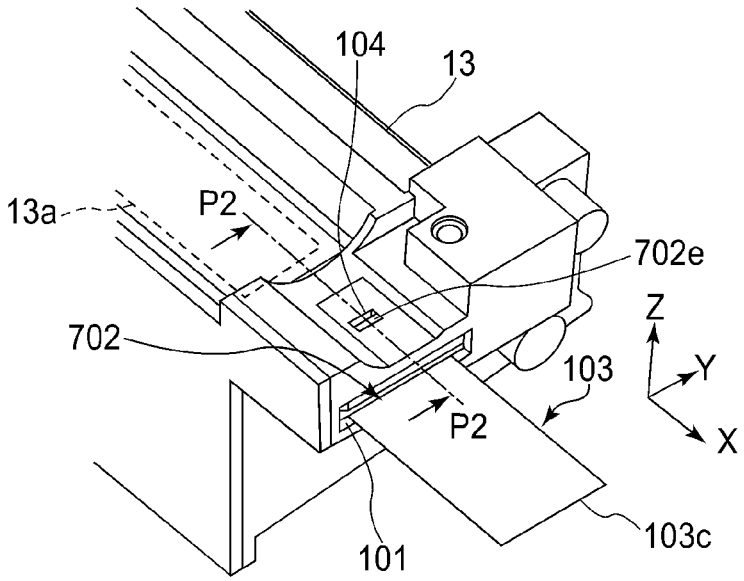
FIG. 15(*a*) is a schematic perspective view of the end portion of the development unit frame of the process cartridge in the fourth embodiment of the present invention, which has the sealing film extraction slit.
Figure 15:
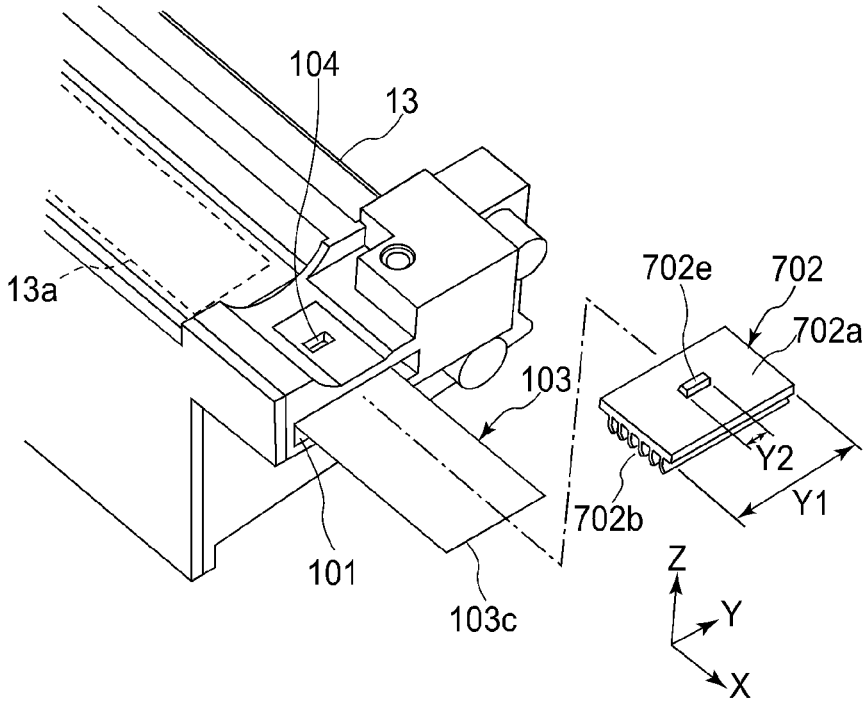
Figure 16:
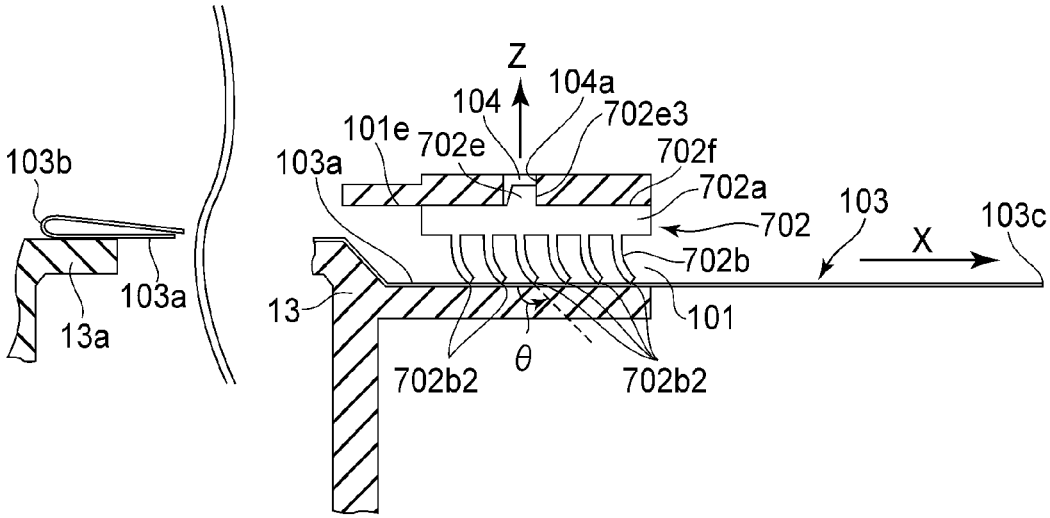
FIG. 16 is a schematic sectional view of the portion of the development unit frame of the process cartridge in the fourth embodiment, in which the sealing film extraction slit and sealing member are present.

Referring to FIGS. 15 and 16, the structure of the sealing member 702 in this embodiment is described.

First, referring to FIG. 2, until the cartridge B is used for the first time, the developer delivery opening 13*d* of the development unit frame 13 is kept sealed with the development unit sealing film 103, which was welded to the rim 13*a* of the developer delivery opening 13*d*. Therefore, the toner T remains hermitically sealed in the developer storage chamber 13*b*. In other words, until the cartridge B is used for the first time, there is no toner in the development chamber 13*c*.

FIG. 15(*a*) is a perspective view of the development unit frame 13, developer storage chamber sealing film 103, and sealing member locking portion 702*e* of the development unit frame 13, before the cartridge B is used for the first time. In order to make it easier to describe the structure of the sealing member 702, FIG. 15 does not show the aforementioned developer bearing member 13, development blade 14, etc.

Referring to FIG. 15(*a*), the portion of the developer storage chamber sealing film 103*d*, which was not welded to the development unit frame 13, is doubled (folded) back at the opposite end of the developer delivery opening 13*d* from where the sealing film extraction slit 101 is present, is extended in the direction indicated by an arrow mark X, is put though the sealing film extraction slit 101, and is extended outward of the development unit frame 13, leaving its end portion 103*c* exposed from the development unit frame 13.

A referential code P2 in FIG. 15(*a*) stands for such a line that is parallel to the lengthwise direction of the development unit frame 13, and also, that coincides with the center of the injection hole 104 in terms of the widthwise direction of the development unit frame 13. FIG. 15(*b*) is a partially exploded perspective view of the lengthwise end portion of the development unit frame 13, in which the sealing member 702 is inserted. The sealing member 702 is inserted into the sealing film extraction slit 101, with the developer storage chamber sealing film 103 being kept flat by being pulled in the direction indicated by the arrow mark X, as will be described later.

FIG. 16 is a schematic sectional view of the sealing member 702 and its adjacencies, at a vertical plane which coincides with the line P2-P2 in FIG. 15(*a*), when the sealing member 702 is properly positioned in the sealing film extraction slit 101. Referring to FIG. 16, there is the developer delivery opening sealing film 103 in the sealing film extraction slit 101, and the end portion 103*c* of the sealing film 103 is exposed from the development unit frame 13. There is also the sealing member 702 in the sealing member extraction slit 101. The sealing member 702 is provided with fins 207*b* for wiping away the toner T having adhered to the sealing film 103, and a sealing member locking portion 702*c* for preventing the sealing member 702 from coming out of the sealing film extraction slit 101 when the sealing film 103 is pulled out of the development unit frame 13.

Further, the sealing member 702 has a base portion 702*a* which supports the abovementioned fins 702*b* and sealing member locking portion 702*e*. The fins 702*b* are the portions of the sealing member 702, against which the sealing film 103 rubs when the film 103 is pulled out of the development unit frame 13, that is, the portions of the sealing member 702, which wipe away the developer (toner T) on the sealing film 103. The fins 702*b* are flexible as will be described later. Further, the fins 702*b* are on the opposite side of the base portion 702*a* from the sealing member locking portion 702*e*.

Next, referring to FIG. 15(*b*), a referential code Y1 stands for the dimension of the sealing member 702 in terms of the direction indicated by an arrow mark Y, and a referential code Y2 stands for the dimension of the sealing member locking portion 702*e* in terms of the direction indicated by the arrow mark Y. The dimension (width) Y2 of the sealing member locking portion 702*e* is less than the dimension (width) Y1 of the base portion 702*a*.

Next, referring to FIG. 16, a referential code θ stands for the angle (of contact) between the sealing film wiping edge portion of each fin 702*b*, and the surface 103*a* of the developer storage chamber sealing film 103, which was facing inward of the developer storage chamber 13*b*.

Referring to FIG. 16, the sealing member 702 in this embodiment is provided with multiple fins 702*b*, as its sealing film wiping portions, which contact the surface 103*a* of the sealing film 103, which was facing inward of the developer storage chamber 13*b*. When the sealing member 702 is in the sealing member extraction slit 101, the fins 702*b* remain elastically bent in such a manner that their film wiping edges are on the downstream side of their base portions in terms of the direction indicated by the arrow mark X. The sealing member locking portion 702*e* is in the form of a protrusion, and protrudes from the base portion 702*a*. As the sealing member 702 is inserted into the sealing member extraction slit 101, the sealing member locking portion 702*e* fits into the hole 104 (which may be referred to as sealing member locking hole, hereafter), which is in the top wall of the sealing member extraction slit 101, and remains fitted in the hole 104 while the sealing member 702 is in the sealing film extraction slit 101. During the extraction of the developer storage chamber sealing film 103 from the development unit frame 13, the sealing film 103 rubs against the film wiping portions 702*b*2, and therefore, the film wiping portions 702*b*2 are subjected to shearing stress directed as indicated by the arrow mark X, being pulled in the direction of the arrow mark X. As the sealing member 702 is pulled in the direction indicated by the arrow mark X, the downstream wall of the sealing member locking portion 702*e* comes into contact with the upstream wall 104*a* of the sealing member locking hole 104, preventing thereby the sealing member 702 from coming out of the sealing film extraction slit 101 in the direction indicated by the arrow mark X. That is, the sealing member locking hole 104, that is, the hole in which the sealing member locking portion 702*e* fits, functions as the portion of the development unit frame 13, which prevents the sealing member 702 from moving in the direction in which the developer storage chamber sealing film 103 is pulled.

The sealing member 702 in this embodiment is formed of thermoplastic elastomer, separately from the development unit frame 13, and is inserted into the sealing film extraction slit 101. If the sealing member 702 is formed of the same type of thermoplastic elastomer as the one for the development unit frame 13, the sealing member 702 does not need to be separated from the development unit frame 13 when the development unit frame 13 (cartridge B) is recycled as the material for the development unit frame 13. Thus, it is desired that the sealing member 702 is formed of the same type of thermoplastic elastomer as that for the development unit frame 13. In this embodiment, therefore, the development unit frame 13 is formed of high impact polystyrene, and the sealing member 702 is formed of thermoplastic elastomer which belongs to a styrene group. The material for the sealing member 702 may be different from the above described one, as long as it is similar in mechanical properties as the material for the sealing member 702 in this embodiment. Next, the process through which the sealing member 702 is inserted into the sealing film extraction slit 101 is described.

(Process for Inserting Sealing Member into Sealing Film Extraction Slit)

The process for inserting the sealing member 702 into the sealing film extraction slit 101 is described with reference to FIGS. 16 and 18.

Figure 18:
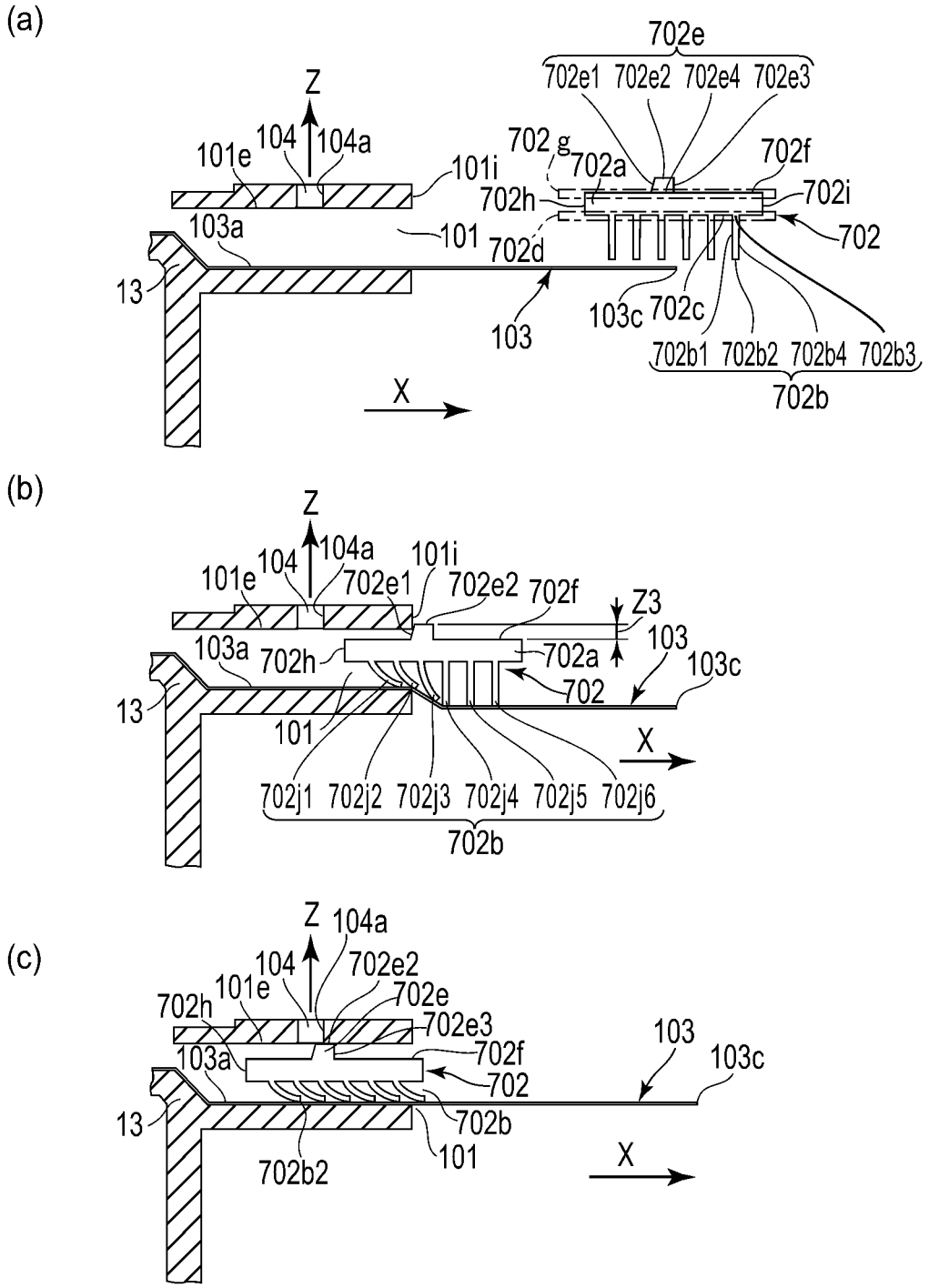
FIGS. 18(*a*), 18(*b*) and 18(*c*) are schematic sectional views of the portion of the development unit frame of the process cartridge in the fourth embodiment, which has the sealing film extraction slit and sealing member, before, during, and after the installation of the sealing member into the slit.

FIGS. 18(*a*)-18(*c*) are schematic sectional views of the combination of the sealing member 702 and sealing film extraction slit 101, at a vertical plane which coincides with the line P2-P2 in FIG. 15, before, at the start of, and after the insertion of the sealing member 702 into the sealing film extraction slit 101, respectively.

Referring to FIG. 18(*a*), before the developer delivery opening sealing member 702 is inserted into the sealing film extraction slit 101, such force that is large enough to tension the sealing film 103, but, not large enough to cause the sealing film 702 to peel from the development unit frame 13, is applied to the end portion 103*c* of the sealing film 103 in the direction indicated by an arrow mark X, in order to rid the sealing film of slack. Next, referring to FIG. 18(*b*), the sealing member 702 is provided with six fins 702*b*, which are the same in shape.

Each fin 702*b* has the upstream surface 702*b*1, in terms of the direction indicated by the arrow mark X, and the film wiping portion (edge) 702*b*2 for wiping away the toner T having adhered to the surface of the developer delivery opening sealing member 103, which was facing inward of the developer storage chamber 13*b*. Further, each fin 701*b* has the base portion 702*b*, by which the fin 702*b* is held to the base portion 702*a*, and the downstream surface 702*b*4 in terms of the direction indicated by the arrow mark X. In addition, the sealing member locking portion 702*e* of the sealing member 702 has the upstream surface 702*e*1 in terms of the direction indicated by the arrow mark X, top surface 702*e*, and downstream surface 702*e*3 in terms of the direction indicated by the arrow mark X. Further, the sealing member locking portion 702*e* has the base portion 702*e*4 by which the sealing member locking portion 702*e* is held to the base portion 702*a* of the sealing member 702. Further, the base portion 702*a* of the sealing member 702 has the bottom combination made up of the downwardly facing surface 702*c* of the base portion 702*a* and the base portions 702*b*3 of the fins 702*b*, and bottom combination 702*g* made up of the top surface 702*f* and base portions 702*e*4 of the base portion 702*a*. The top surface 101*e*2 of the sealing film extraction slit 101, top surface 702*f* of the base portion 702*a*, and the downward facing surface 702*c* of the base portion 702*a* are roughly parallel to each other.

Referring to FIG. 18(*b*), when the sealing member 702 is inserted into the sealing film extraction slit 101 in the opposite direction from the direction indicated by the arrow mark X, it is the upstream surface 702*h* of the base portion 702*a*, in terms of the direction indicated by the arrow mark X that enters the sealing film extraction slit 101 first. As the sealing member 702 enters the sealing member extraction slit 101, the fin 702*j*1, which is the most upstream fin in terms of the direction indicated by the arrow mark X, first comes into contact with the surface 103*a* of the sealing film 103, which is facing inward of the developer storage chamber 13*b*, and is gradually bent downstream. As the fin 702*b* is bent downstream, the film wiping portion 702*b* of the sealing film 103 is subjected to the reaction force generated in the direction indicated by an arrow mark Z by the bending of the fin 702*b*, by the surface 103*a* of the sealing film 103, which is facing inward of the developer storage chamber 13*b*. As the sealing member 702 is inserted further into the sealing film extraction slit 101 in the opposite direction from the direction indicated by the arrow mark X, the fins 702*j*2 and 702*j*3, that is, the downstream fins relative to the most upstream fin 702*j*1, sequentially come into contact with the surface 103*a* of the sealing film 103, which is facing inward of the developer storage chamber 13*b*, and are sequentially bent in the downstream direction indicated by the arrow mark X. Just about the time when the fin 702*j*3 comes into contact with the surface 103*a* of the sealing film 103, the upstream surface 702*e*1 of the base portion 702*a* of the sealing member 702 comes into contact with the outward edge 101*i* of the sealing film extraction slit 101. Then, as the sealing member 702 is inserted further into the sealing film extraction slit 101, the upstream surface 702*e*1 of the base portion 702*a* of the sealing member 702 is guided in the opposite direction from the direction indicated by the arrow mark X while rubbing the outward edge 101*i* of the sealing film extraction slit 101. Therefore, the fins 702*j*1-702*j*3, which are already in the sealing film extraction slit 101 and bent, are further bent by an amount equivalent to an amount (height) Z3 shown in FIG. 18(*b*), increasing the abovementioned reaction force.

The height (vertical dimension in FIG. 18(*b*)) of the fins 702*j*1-702*j*3 are substantially greater than that of the sealing member locking portion 702*e*. Therefore, even though the sealing member locking portion 702*e* protrudes upward from the base portion 702*a* of the sealing member 702, the sealing member 702 can be inserted into the sealing film extraction slit 101 by bending the fins 702*j*1-702*j*3.

Next, referring to FIG. 18(*c*), as the sealing member 702 is inserted further into the sealing film extraction slit 101 in the opposite direction from the direction indicated by the arrow mark X, the fins 702*j*4-702*j*6, which are on the downstream side of the sealing member locking portion 702*e* in terms of the direction indicated by the arrow mark X sequentially come into contact with the surface 103*a* of the sealing film 103, which is facing inward of the developer storage chamber 13*b*, and are gradually bent downstream in terms of the direction indicated by the arrow mark X. Thus, the film wiping portions 702*b*2 are under the reaction force from the surface 103*a* of the sealing film 103, generated in the direction indicated by the arrow mark Z by the bending of the fins 702*b*. Thus, the top surface 702*e* of the base portion 702*a* of the sealing member 702 is placed, and kept in contact, with the top surface 101*e* of the sealing film extraction slit 101, by this reaction force. Therefore, the base portion 702*a* becomes, and remains, roughly parallel to the top surface 101*e* of the sealing film extraction slit 101. Thus, while the sealing member 702 is inserted further into the sealing film extraction slit 101, the top surface 702*e*2 of the sealing member 702 continue to rub the top surface 101*e* of the sealing film extraction slit 101, and the film wiping portions 702*b*2 of the fins 702*b* of the sealing member 702 continues to rub the surface 103*a* of the developer storage opening sealing film 103, which is facing inward of the developer storage chamber 13*b*. As the sealing member 702 is inserted further into the sealing film extraction slit 101, the top surface 702*e*2 of the sealing member locking portion 702*e* becomes separated from the top surface 101*e* of the sealing film extraction slit 101, because of the presence of the sealing member locking hole 104 in the top wall of the sealing film extraction slit 101. Thus, the sealing member locking portion 702*e* is forced into the sealing member locking hole 104 in the direction indicated by the arrow mark Z, by the aforementioned reaction force which is directed as indicated by the arrow mark Z, and to which the film wiping portions 702*b*2 are subjected. The sealing member locking portion 702*e* enters the sealing member locking hole 104 as far as the top surface 702*f* of the base portion 702*a* of the sealing member 702 comes into contact with the top surface 101*e* of the sealing film extraction slit 101. As the sealing member locking portion 702 enters the sealing member locking hole 104 as far as the top surface 702*f* comes into contact with the top surface 101*e*, the bending of the multiple fins 702*b* is reduced by an amount equivalent to the dimension (height) Z3 in FIG. 18(*b*). Consequently, the state of contact between the film wiping portion 702*b*2 of each fin 702*b* becomes such that the angle of contact between the film wiping portion 702*b*2 and the surface 103*a* of the sealing film 103, which is facing inward of the developer storage chamber 13*b* of the development unit frame 13 is θ.

(Function of Sealing Member)

Next, referring to FIGS. 15-19, the function of the sealing member 702 in this embodiment is described.

Referring to FIG. 2, the development storage chamber sealing film 103 keeps the toner T sealed in the developer storage chamber 13*b*. Therefore, the toner T adheres to the surface 103*a* of the sealing film 103, which is facing inward of the developer storage chamber 13*b*. Before the cartridge B is used for the first time, a user has to pull the developer storage chamber sealing film 103 out of the development unit frame 13 by pulling the sealing film 103 in the direction indicated by the arrow mark X, by the portion of the sealing film 103, which is exposed from the development unit frame 13, as shown in FIG. 15. As the sealing film 103 is pulled, the sealing film 103 begins to peel away from the edge of the developer delivery opening 13*d*. More specifically, the sealing film 103 begins to peel away in the direction indicted by the arrow mark X, starting from the portion 103*b* of the edge of the developer delivery opening 13*d*, at which the sealing film 103 is doubled back in the direction indicated by the arrow mark X as shown in FIG. 16(*a*). Thus, the portion of the surface 103*a* of the sealing film 103, which was facing inward of the developer storage chamber 13*b*, rubs against the film wiping portions 702*b*2 of the sealing member 702, whereby the toner T having adhered to the portion of the surface 103*a* of the sealing film 103, is wiped away by the film wiping portions 702*b*2. Therefore, the toner T having adhered to the portion of the surface 103*a* of the sealing film 103, which was facing inward of the developer storage chamber 13*b*, is prevented from leaking through the sealing film extraction slit 101. In other words, it is possible to prevent the problem that the toner T leaks through the sealing film extraction slit 101 when the developer storage chamber sealing film 103 is pulled out of the development unit frame 13.

Figure 17:
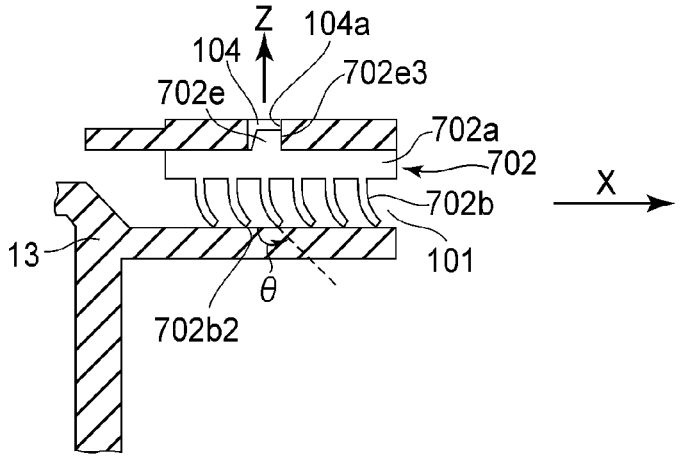
FIG. 17 is a schematic sectional view of the portion of the development unit frame of the process cartridge in the fourth embodiment, which has the sealing film extraction slit and sealing member.

FIG. 17 is a schematic sectional view of the developer storage chamber sealing member 702 and sealing film extraction slit 101, at the vertical line P2-P2 in FIG. 15, after the extraction of the developer delivery opening sealing film 103 from the development unit frame 13. It shows the shape of the sealing member 702 after the extraction of the sealing film 103. Referring to FIG. 17, the sealing member 702 is held in the sealing film extraction slit 101 even after the extraction of the developer delivery opening sealing film 103 from the development unit frame 13. Therefore, it can prevent the toner T from leaking through the sealing film extraction slit 101 even during the usage of the cartridge B.

(Comparison between Sealing Member in Fourth Embodiment and Comparative Sealing Member)

Figure 24:
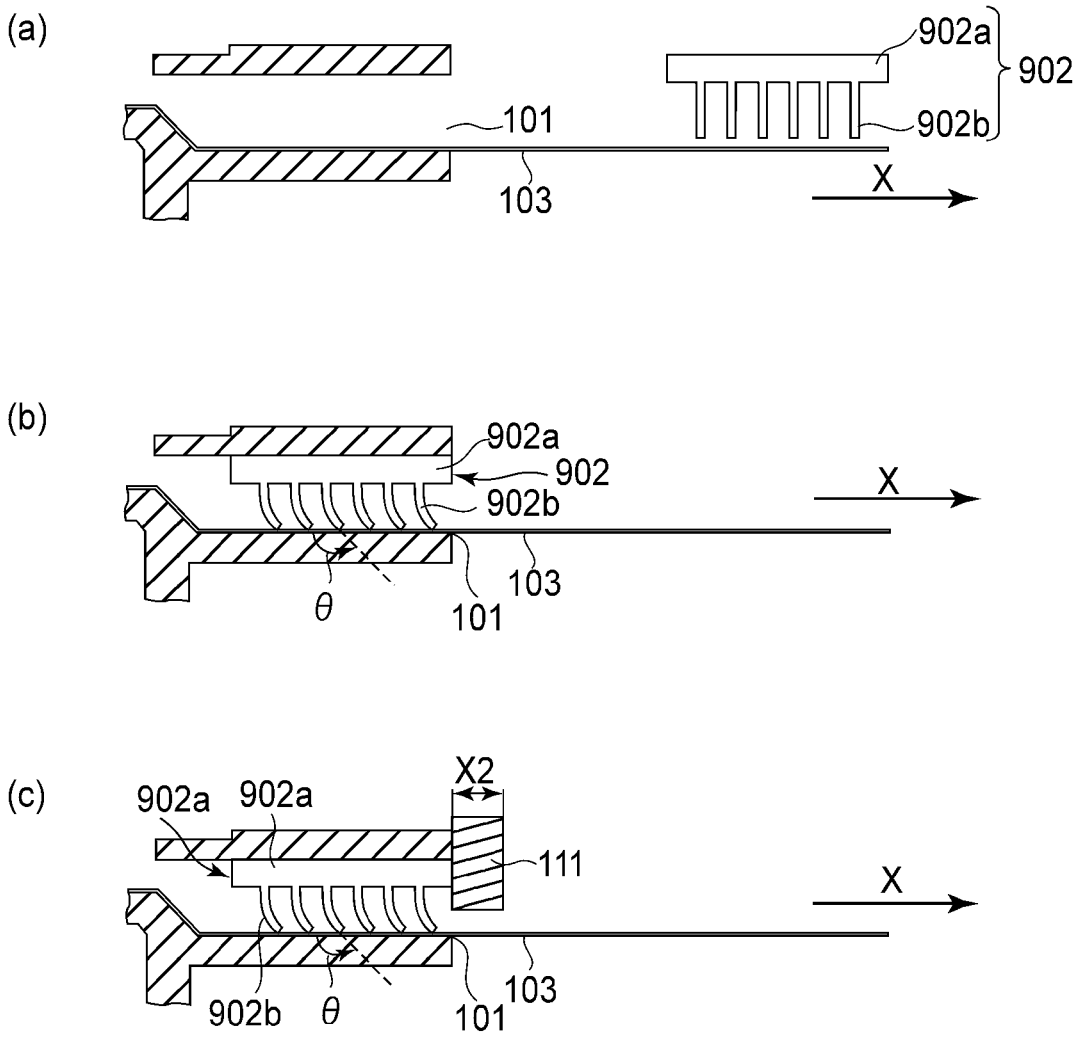
FIGS. 24(*a*), 24(*b*) and 24(*c*) are schematic sectional views of the portion of the development unit frame of the comparative process cartridge, which has the sealing film extraction slit and sealing member. They show the portion before, during, and after the insertion of the sealing member into the slit.

Here, in order to verify the effectiveness of the sealing member 702 in this embodiment, a comparative sealing member 902 is shown in FIGS. 24(*a*), 24(*b*) and 24(*c*), which are schematic sectional views of the comparative sealing member 902.

In the case where the comparative sealing member 902 is used to keep the developer storage chamber 13*b* sealed, the developer storage chamber sealing film 103 rubs against the fins 902*b* when the sealing film 103 is pulled out of the development unit frame 13. Thus, the fins 902*b* are subjected to such shearing stress that works in the direction indicated by an arrow mark X. Therefore, a means that can prevent the sealing member 902 from being moved out of the sealing film extraction slit 101 by the shearing stress directed as shown by the arrow mark X is necessary. One of the solutions to this issue is to provide the development unit frame 13 with a sealing member retaining member 111, which is positioned at the outward end of the sealing film extraction slit 101 as shown in FIG. 24(*c*).

However, in the case where the sealing member retaining member 111, which is separately manufactured from the development unit frame 13, is attached to the development unit frame 13 as shown in FIG. 24(*c*), the cartridge B becomes larger by an amount equivalent to the width X2 of the sealing member retaining member 111 (dimension of retaining member in terms of lengthwise direction of development unit frame 13), making it necessary for the chamber in the main assembly of an image forming apparatus to be increased by an amount equivalent to the width X2 of the sealing member retaining member 111, which may result in increase in the size of an electrophotographic image forming apparatus. It also possible that the process cartridge of an electrophotographic image forming apparatus may be restricted in terms of the positioning of the other components than the process cartridge. Moreover, if the sealing member 902 is reduced in the number of the fins 902*b* to compensate for the space taken up by the sealing member retaining member 111, the width of which is X2, the sealing member 902 and sealing film extraction slit 101 have to be more strictly controlled in measurement, in order to compensate for the problem that reducing the sealing member 902 in fin count is likely to reduce the group of fins 902*b* of sealing member 902 in its effectiveness in terms of the removal of the toner T from the sealing film 103. Strictly controlling the process for manufacturing the cartridge B in terms of the measurement of the sealing film extraction slit 101 and sealing member 902 adds to the cost of the cartridge B. Further, manufacturing the sealing member retaining member 111 separately from the development unit frame 13 and/or sealing member 902 adds to the component cost for the cartridge B, and also, increases the number of steps in the process for assembling the cartridge B, which further increases in cost the cartridge B.

In comparison, in the case of the sealing member 702 in the fourth embodiment, its sealing member locking portion 702*e* is an integral part of the sealing member 702 (it protrudes from base portion 702*a*). Therefore, the sealing member retaining member 111, the width of which is X2, is unnecessary, making it unnecessary to increase in size the cartridge chamber of the main assembly of an electrophotographic image forming apparatus by the amount equivalent to the width X of the sealing member retaining member 111. In other words, using the sealing member 702 in this embodiment in stead of the comparative sealing member 902 can provide a process cartridge which is significantly smaller in dimension in terms of its lengthwise direction than a process cartridge which uses the comparative sealing member 902. Further, using the sealing member 702 in this embodiment does not require the step necessary to attach the comparative sealing member (conventional sealing member) 902 (FIG. 24(*c*)) to the development unit frame 13. In other words, the sealing member 702 can simplify and shorten the process for assembling (manufacturing) the process cartridge B.

Figure 19:
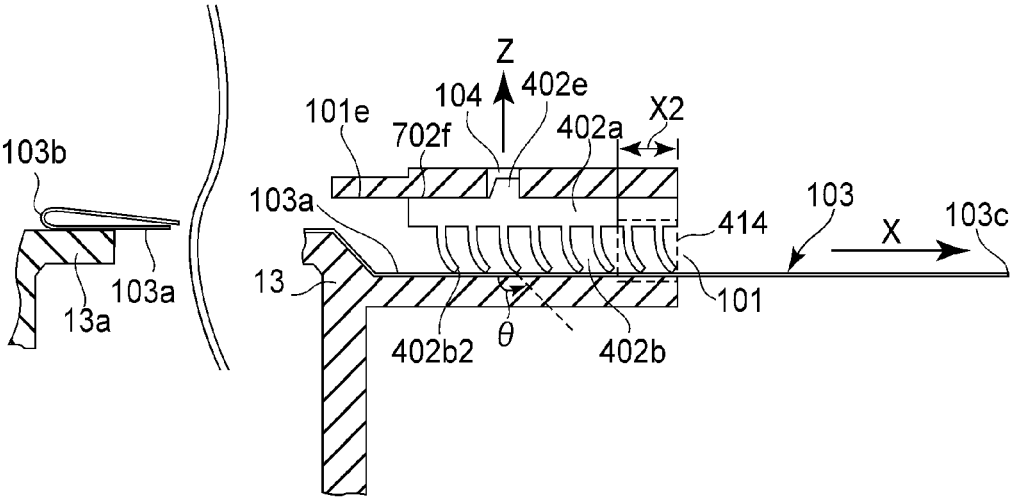
FIG. 19 is a schematic sectional view of the sealing member, and its adjacencies, of the process cartridge in the fourth embodiment, and shows the structure of the sealing member.

On the other hand, let's think about the case in which the sealing member 702 is increased in the number of its fins 702*b* by the number equivalent to the width X2 of the sealing member retaining member 111. FIG. 19 is a schematic sectional view of a sealing member 402, which was created to utilize the space which would have been occupied by the sealing member retaining member 111. The number of the fins 414 of the sealing member 402 is greater by a value equivalent to the width X2 of the sealing member retaining member 111 than the comparative sealing member 902.

Using the sealing member 402 increases by a value equal to the number of film wiping portion 402*b*2 (additional film wiping portions), the number of times the developer storage chamber sealing film 103 is wiped (by the film wiping portions) when the sealing film 103 is pulled out of the development unit frame 13 through the sealing film extraction slit 101 in the direction indicated by an arrow mark X. In other words, the sealing member 402 is superior in performance in terms of ability to wipe away the toner T on the developer storage chamber sealing film 103. In addition, not only does the sealing member 702 in this embodiment function as the sealing member 902 shown in FIG. 24(*c*), but also, as the sealing member retaining member 111. Therefore, it can reduce in cost the cartridge B.

Figure 20:
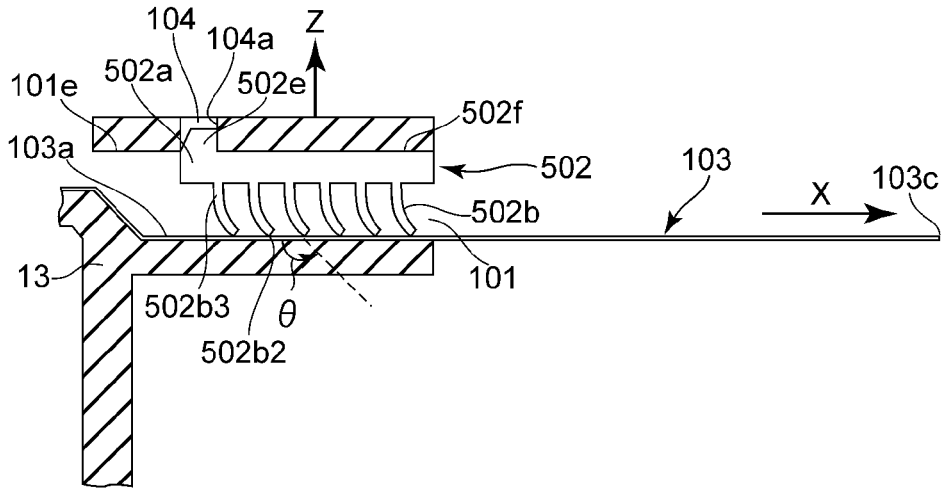
FIG. 20(*a*) is a schematic sectional view of the portion of the development unit frame of the process cartridge in the fourth embodiment, which has one of the modified versions of the sealing member in the fourth embodiment. It shows the structure of the modified version of the sealing member.
Figure 20:
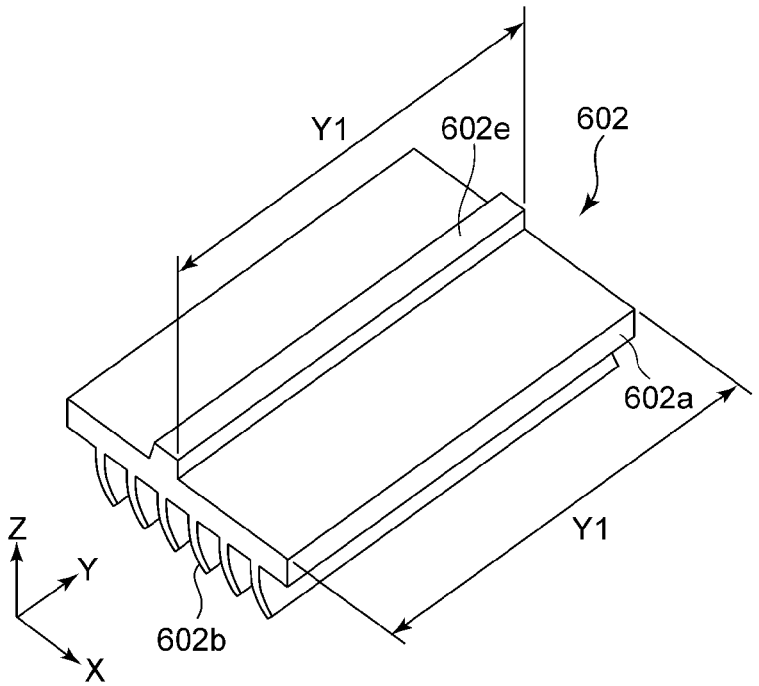
Figure 21:
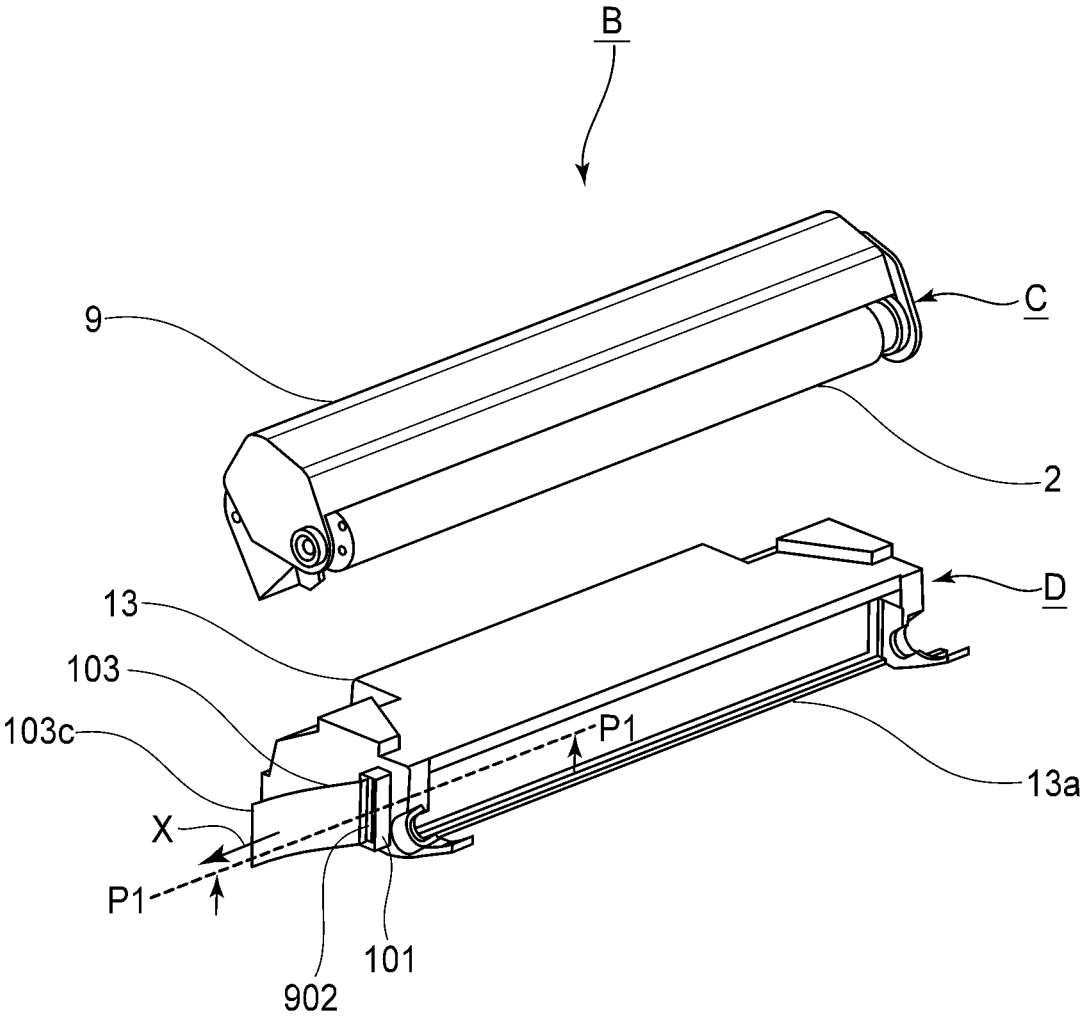
FIG. 21 is an exploded perspective view of a comparative process cartridge, and shows the structure of the cartridge.

Referring to FIG. 16, the sealing member locking portion 702*e* of the sealing member 702 in this embodiment, which is for preventing the sealing member 702 from coming out of the sealing film extraction slit 101 when the developer storage chamber sealing film 103 is pulled out of the development unit frame 13, is at the midpoint among the multiple fins 702*b* of the sealing member 702 in terms of the direction indicated by the arrow mark X. However, it may be at the upstream end of the group of multiple fins 702*b* in terms of the direction indicated by the arrow mark X, like the sealing member locking portion 502*e* of the sealing member 502 shown in FIG. 20(*a*).

In addition, in this embodiment, the sealing member 702 was structured so that the width Y2 of its locking portion 702*e* in terms of the direction indicated by the arrow mark Y became less than the width Y1 of the base portion 702*a*, as shown in FIG. 15(*b*). However, the sealing member 702 may be structured like the sealing member 602, shown in FIG. 20(*b*), the width of the locking portion 602*a* of which is the same as the width of its base portion 602*a*. That is, the sealing member 702 may be structured so that the width Y2 of its locking portion 702*e* becomes the same as the width Y1 of its base portion 702*a*. The effectiveness of the sealing members 502 and 602 shown in FIGS. 20(*a*) and 20(*b*), respectively, is the same as that of the above described sealing member 702 in this embodiment.

As described above, any one of the sealing members 702, 503 and 602 can satisfactorily wipe away the toner T on the developer storage chamber sealing film 103, without being pulled out of the sealing film extraction slit 101 by the sealing film 103, when the sealing film 103 is pulled out of the development unit frame 13 through the sealing film extraction slit 101. Further, they do not increase the development unit frame 13 (cartridge B) in length, and do not add to the cost of the development unit frame 13 (cartridge B). Moreover, they can simplify the process for placing a sealing member in the sealing film extraction slit 101.

That is, this embodiment of the present invention can simplify the process for immovably placing a sealing member in the sealing film extraction slit 101, and therefore, can simplify the process for assembling the cartridge B, because the sealing member locking portion 702*e* automatically fits into the sealing member locking (regulating) hole 104 of the development unit frame 13 while the sealing member 702 is inserted into the sealing film extraction slit 101.

In each of the above described embodiments of the present invention, the development unit D from which the sealing film 103 is to be pulled out by a user was a part of a developing apparatus (device). However, the present invention is also applicable to a sealing member for the development unit frame of a process cartridge removably installable in an image forming apparatus equipped with an internal mechanism for automatically pulling the sealing film out of its development unit. Further, the development unit D was an integral part of the cartridge B. However, the present invention is also applicable to a sealing member for a development unit in the form of a cartridge which is removably installable in the main assembly of an image forming apparatus A. Further, the image forming apparatus was a laser beam printer. However, the present invention is also applicable to a sealing member for the developing device (apparatus) or development unit removably installable in the main assembly of a copying machine, a facsimile machine, or the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 249893/2011, 101130/2012 and 234028/2012 filed Nov. 15, 2011, Apr. 26, 2012 and Oct. 23, 2012, respectively, which are hereby incorporated by reference.

What is claimed is:

1. A developing device for an image forming apparatus, said developing device comprising:

a frame provided with (i) a developer accommodating chamber accommodating developer and (ii) a development opening for supplying developer from inside of said developer accommodating chamber to outside of said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is integrally molded on said frame by injecting a thermoplastic elastomer into a space between said first sealing member and an edge of said pulling opening, and wherein said second sealing member is provided with a retaining portion for preventing said second sealing member from moving in a pulling direction of said first sealing member by engaging with a regulating portion of said frame.

2. A device according to claim 1, wherein said regulating portion includes a groove portion of said frame.

3. A process cartridge detachably mountable to a main assembly of an image forming apparatus, said process cartridge comprising:

an image bearing member for bearing a latent image;

a developer carrying member for carrying developer;

a frame provided with (i) a developer accommodating chamber accommodating developer, (ii) a developing chamber holding said developer carrying member, and (iii) a development opening for fluid communication between said developing chamber and said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is integrally molded on said frame by injecting a thermoplastic elastomer into a space between said first sealing member and an edge of said pulling opening, and wherein said second sealing member is provided with a retaining portion for preventing said second sealing member from moving in a pulling direction of said first sealing member by engaging with a regulating portion of said frame.

4. A developing device for an image forming apparatus, said developing device comprising:

a frame provided with (i) a developer accommodating chamber accommodating developer and (ii) a development opening for supplying developer from inside of said developer accommodating chamber to outside of said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is integrally molded on said frame by injecting a thermoplastic elastomer into a space between said first sealing member and an edge of said pulling opening, and wherein an angle is formed between an upstream side surface of said second sealing member in the pulling direction of said first sealing member and a sliding surface of said second sealing member relative to said first sealing member.

5. A developing device for an image forming apparatus, said developing device comprising:

a frame provided with (i) a developer accommodating chamber accommodating developer and (ii) a development opening for supplying developer from inside of said developer accommodating chamber to outside of said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is integrally molded on said frame by injecting a thermoplastic elastomer into a space between said first sealing member and an edge of said pulling opening, and wherein said second sealing member comprises a primary monomer of monomers of material of said frame.

6. A developing device for an image forming apparatus, said developing device comprising:

a frame provided with (i) a developer accommodating chamber accommodating developer, (ii) a development opening for supplying developer from inside of said developer accommodating chamber to outside of said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is provided with a retaining portion for preventing said second sealing member from moving in a pulling direction of said first sealing member by engaging with a regulating portion of said frame, and wherein said retaining portion is provided at a side of said second sealing member opposite a side that faces said first sealing member.

7. A developing device for an image forming apparatus, said developing device comprising:

a frame provided with (i) a developer accommodating chamber accommodating developer, (ii) a development opening for supplying developer from inside of said developer accommodating chamber to outside of said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is provided with a retaining portion for preventing said second sealing member from moving in a pulling direction of said first sealing member by engaging with a regulating portion of said frame, wherein a rubbing portion of said second sealing member referring to said first sealing member is provided with a flexible wiping portion for wiping said first sealing member to remove developer therefrom, and wherein said retaining portion includes a projection projecting away from said wiping portion, said projection having a height that is smaller than a height of said wiping portion.

8. A process cartridge according to claim 3, wherein said retaining portion is provided at a side of said second sealing member opposite a side that faces said first sealing member.

9. A process cartridge according to claim 3, wherein said regulating portion includes a groove portion of said frame.

10. A device according to claim 1, wherein said retaining portion is provided at a side of said second sealing member opposite a side that faces said first sealing member.

11. A process cartridge detachably mountable to a main assembly of an image forming apparatus, said process cartridge comprising:

an image bearing member for bearing a latent image;

a developer carrying member for carrying developer;

a frame provided with (i) a developer accommodating chamber accommodating developer, (ii) a developing chamber holding said developer carrying member, and (iii) a development opening for fluid communication between said developing chamber and said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is integrally molded on said frame by injecting a thermoplastic elastomer into a space between said first sealing member and an edge of said pulling opening, and wherein an angle is formed between an upstream side surface of said second sealing member in the pulling direction of said first sealing member and a sliding surface of said second sealing member relative to said first sealing member.

12. A process cartridge detachably mountable to a main assembly of an image forming apparatus, said process cartridge comprising:

an image bearing member for bearing a latent image;

a developer carrying member for carrying developer;

a frame provided with (i) a developer accommodating chamber accommodating developer, (ii) a developing chamber holding said developer carrying member, and (iii) a development opening for fluid communication between said developing chamber and said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is integrally molded on said frame by injecting a thermoplastic elastomer into a space between said first sealing member and an edge of said pulling opening, and wherein said second sealing member comprises a primary monomer of monomers of material of said frame.

13. A process cartridge detachably mountable to a main assembly of an image forming apparatus, said process cartridge comprising:

an image bearing member for bearing a latent image;

a developer carrying member for carrying developer;

a frame provided with (i) a developer accommodating chamber accommodating developer, (ii) a developing chamber holding said developer carrying member, and (iii) a development opening for fluid communication between said developing chamber and said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is provided with a retaining portion for preventing said second sealing member from moving in a pulling direction of said first sealing member, by engaging with a regulating portion of said frame, and wherein said retaining portion is provided at a side of said second sealing member opposite a side that faces said first sealing member.

14. A process cartridge, detachably mountable to a main assembly of an image forming apparatus, said process cartridge comprising:

an image bearing member for bearing a latent image;

a developer carrying member for carrying developer;

a frame provided with (i) a developer accommodating chamber accommodating developer, (ii) a developing chamber holding said developer carrying member, and (iii) a development opening for fluid communication between said developing chamber and said developer accommodating chamber;

a first sealing member sealing said development opening, said first sealing member being dismountable from said development opening by being pulled out through a pulling opening provided in said frame; and a second sealing member for sliding on said first sealing member to prevent developer from leaking to outside of said frame through said pulling opening when said first sealing member is pulled through said pulling opening, wherein said second sealing member is provided with a retaining portion for preventing said second sealing member from moving in a pulling direction of said first sealing member, by engaging with a portion of said frame, wherein a rubbing portion of said second sealing member referring to said first sealing member is provided with a flexible wiping portion for wiping said first sealing member to remove developer therefrom, and wherein said retaining portion includes a projection projecting away from said wiping portion, said projection having a height that is smaller than a height of said wiping portion.

15. An assembling method for a developing device, said assembling method comprising:

preparing a frame provided with (i) a developer accommodating chamber accommodating a developer, (ii) a development opening for supplying developer from inside of the developer accommodating chamber to outside of the developer accommodating chamber, and (iii) a pulling opening through which a first sealing member for sealing the development opening is pulled; and providing a second sealing member by injecting a thermoplastic elastomer into a space between the first sealing member and the pulling opening in a state that the first sealing member is mounted to the development opening to seal the development opening, thus sealing the pulling opening, wherein a regulating portion is provided for suppressing movement of the second sealing member in a pulling direction of the first sealing member, and said assembling method further comprises providing the second sealing member with a retaining portion for engaging with the regulating portion by filling the thermoplastic elastomer in the regulating portion.

* * * * *